US006229253B1

(12) United States Patent
Iwata et al.

(10) Patent No.: US 6,229,253 B1
(45) Date of Patent: May 8, 2001

(54) SPARK PLUG WITH SPECIFIC GAP BETWEEN INSULATOR AND ELECTRODES

(75) Inventors: Kazuya Iwata, Hashima-gun; Takahiro Suzuki, Nagoya; Yoshihiro Matsubara, Yokkaichi, all of (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/329,311

(22) Filed: Jun. 10, 1999

(30) Foreign Application Priority Data

Jun. 11, 1998 (JP) ..... 10-179625
Apr. 30, 1999 (JP) ..... 11-124504

(51) Int. Cl.[7] ..... H01T 13/20
(52) U.S. Cl. ..... 313/141; 313/143
(58) Field of Search ..... 313/141, 143

(56) References Cited

U.S. PATENT DOCUMENTS 5,581,145 12/1996 Kato et al. ..... 313/141

FOREIGN PATENT DOCUMENTS 0 774 812 A1 5/1997 (EP) .
49-120932 2/1973 (JP) .
58-59580 4/1983 (JP) .
59-71279 4/1984 (JP) .
60-81784 5/1985 (JP) .
60-180082 9/1985 (JP) .
5-326107 12/1993 (JP) .

*Primary Examiner*—Vip Patel
(74) *Attorney, Agent, or Firm*—Morgan, Lewis & Bockius LLP

(57) ABSTRACT

In a spark plug, a main air gap (A) is formed between a parallel ground electrode (11) and the end face of a central electrode (2), a semi-surface gap (B) is formed between the end face (12C) of a semi-surface ground electrode (12) and the side face (2A) of the central electrode (2) and a semi-surface air gap (C) is formed between the end face (12C) and the side face (1E) of insulator. In addition, difference in a level E between the height of the lower end face (1D) of the insulator (1) and the height of the upper edge (12B) of the end face 12C of the semi-surface ground electrode 12 is E≦+0.7 mm, the distance B of the semi-surface gap (B) is longer than the distance A of the main air gap (A) and the distance C of the semi-surface air gap (C) and the insulator is shorter than the distance A of the main air gap (A).

14 Claims, 14 Drawing Sheets

SPARK PLUG WITH SPECIFIC GAP BETWEEN INSULATOR AND ELECTRODES

BACKGROUND OF THE INVENTION

1. Field of the Invention

The present invention relates to a spark plug used for the igniter of an internal combustion engine.

2. Description of the Related Art

Generally, a conventional type spark plug is provided with a central electrode and a parallel ground electrode. The central electrode is protruded downward from the lower end face of insulator. The parallel ground electrode is arranged opposite to the central electrode and one end of which is bonded to main metal shell for igniting fuel mixed gas by spark discharge in an air gap between the central electrode and the parallel ground electrode.

To enhance ignitability in the air gap, a spark plug provided with auxiliary ground electrodes opposite to the side face of a central electrode in addition to a parallel ground electrode opposite to the end face of the central electrode is proposed in Unexamined Japanese Patent Publication (kokai) No. Hei. 5-326107, U.S. Pat. No. 5,581,145 and EP 0 774 812A. These auxiliary ground electrodes are not provided to fly sparks in a gap between the auxiliary ground electrode and the central electrode. However, these auxiliary ground electrodes are provided to improve the distribution of electric fields between the parallel ground electrode and the central electrode by the existence of the auxiliary ground electrodes. Accordingly, ignitability is enhanced by flying a spark in the gap between the parallel ground electrode and the central electrode at lower discharge voltage. Therefore, in the structure of these spark plugs, the edge of the end face of the auxiliary ground electrode is not necessarily positioned in the vicinity of the lower end face of the insulator.

Further, in U.S. patent application Ser. No. 08/749,309 and EP 0 774,812 A, a spark plug provided with an auxiliary ground electrode in the vicinity of the lower end face of insulator in addition to a parallel ground electrode opposite to the end face of a central electrode is proposed.

However, there is a problem that both conventional type spark plug disclosed in Unexamined Japanese Patent Publication No. Hei5-326107 and U.S. Pat. No. 5,581,145 are weak in a so-called carbon fouling. At the time of regular operation in which an internal combustion engine is rotated at engine speed equal to or faster than predetermined engine speed at predetermined temperature, a leg portion which is a lower part of the insulator of the spark plug is suitably burned and surface temperature in the vicinity of the lower end face of the insulator inside a combustion chamber rises up to approximately 500° C. Therefore, carbon which adheres to the surface of the insulator is burned and the surface of the insulator is kept clean. Therefore, no carbon fouling is caused. However, in the case of a low load in which the temperature of the internal combustion engine is extremely low and the engine speed is also low, the surface temperature of the insulator does not rise, carbon by the combustion adheres to the surface of the insulator and is accumulated to be a so-called carbon fouling state. When this further progresses, insulation between the central electrode and the ground electrode is deteriorated, spark discharge is disabled and an engine stall is caused.

As for the conventional type spark plug disclosed in U.S. patent application Ser. No. 08/749,309, relationship between distance (a main air gap or a semi-surface gap) from the parallel ground electrode or the auxiliary ground electrode to the central electrode and distance (a gap between a semi-surface and the insulator) from the end face of the auxiliary ground electrode to the side face of the insulator is not disclosed.

Further, in Unexamined Japanese Patent Publication (kokai) No. Sho. 59-71279, a semi-surface spark plug in which an ground electrode is arranged opposite to the side face of insulator is disclosed. In the above spark plug, as sparks fly along the surface of the insulator, carbon which adheres to the surface of the insulator is burned off and the problem of a carbon fouling is hardly caused. However, as sparks always fly along the surface of the insulator, the problem of so-called channeling that the surface of the insulator is damaged by sparks is caused. Therefore, there is a problem that the life of the spark plug is short.

SUMMARY OF THE INVENTION

It is an object of the present invention to provide a spark plug strong in a carbon fouling, the life of which is long and also excellent in ignitability.

A spark plug according to the present invention comprises an insulator, a central electrode, a main metal shell, a parallel ground electrode and at least one semi-surface ground electrode. The insulator has a central through hole. The central electrode is held in said central through hole and protruded from the lower end face of said insulator downward. The main metal shell for holding said insulator. The parallel ground electrode having one end which is bonded to the main metal shell and the other end which is arranged so that the other end is opposite to the end face of said central electrode for holding said insulator and a parallel ground electrode arranged. A main air gap (A) is formed by said parallel ground electrode and the end face of said central electrode. The at least one semi-surface ground electrode has one end which is bonded to said main metal shell and the other end which is arranged so that the other end is opposite to the side face of said central electrode or the side face of said insulator. A semi-surface gap (B) is formed between the end face of the other end of said semi-surface ground electrode and the side face of said central electrode opposite to the end face. A gap (C) between a semi-surface ground electrode and the insulator (hereinafter, referred to "a semi-surface air gap (C)) is formed between the end face of said semi-surface ground electrode and the side face of said insulator opposite to the end face. In the spark plug, difference in a level E between the height of the lower end face of said insulator and the height of the upper edge of the end face of said semi-surface ground electrode is equal to or smaller than +0.7 mm where '+' means a direction in which the upper edge of the end face of the semi-surface ground electrode separates downward from the lower end face of the insulator. The distance B of said semi-surface gap (B) is longer than the distance A of said main air gap (A). If a first extended line acquired by extending a line showing said lower end face of said insulator outward, a second extended line acquired by extending a line showing the side face in the vicinity of the semi-surface gap (B) of said insulator in the direction of said lower end face and a third extended line acquired by extending a line showing the end face of said semi-surface ground electrode downward are drawn in case the end face of said semi-surface ground electrode and said insulator are cut along the central axis of said insulator, distance that is a distance C of a semi-surface air gap (C) between the intersection of said first and second extended lines and the intersection of said first and third extended lines is shorter than the distance A of said main air gap (A).

DETAILED DESCRIPTION OF THE INVENTION

Figure 1:
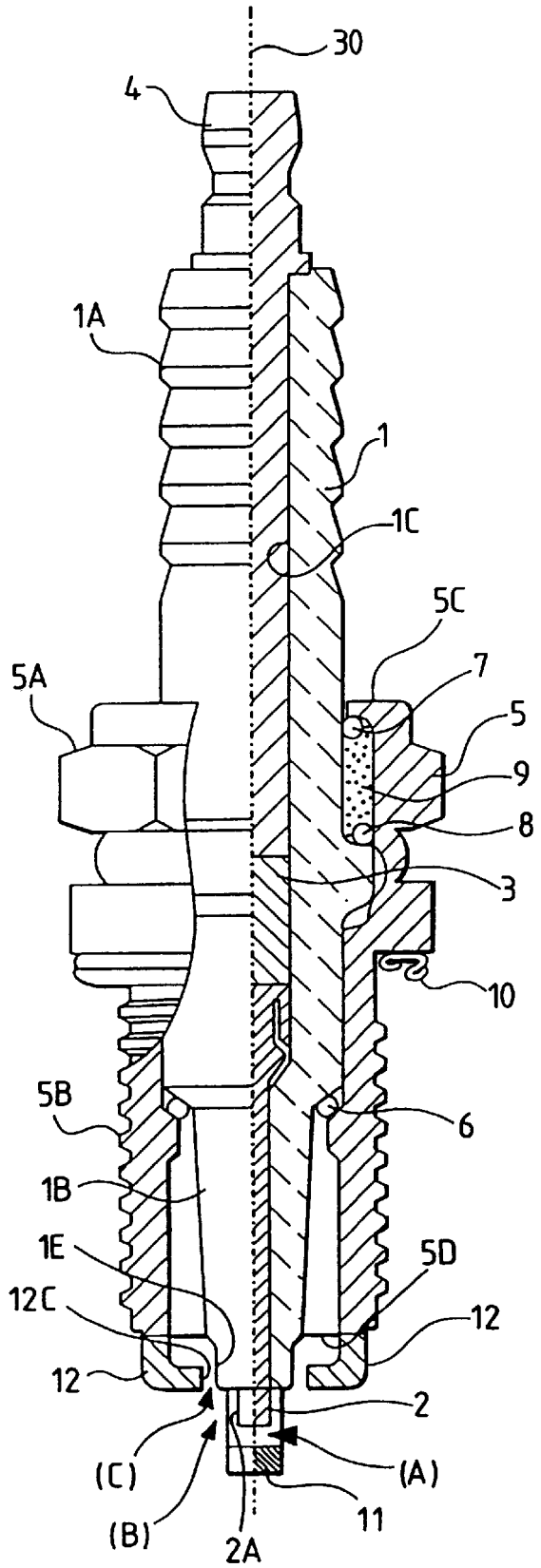
FIG. 1 is a partial sectional view showing a spark plug equivalent to a first embodiment.

Detailed description of the present invention will be described as follows.

A spark plug according to the present invention is structured by an insulator, a central electrode, a main metal shell, a parallel ground electrode and a parallel ground electrode. The insulator is provided with a central through hole. The central electrode is held in the above central through hole and protruded downward from the lower end face of the insulator. The main metal shell holds the insulator. The parallel ground electrode has one end which is bonded to the main metal shell and the other end which is arranged opposite to the end face of the central electrode. A main air gap (A) is formed by the parallel ground electrode and the end face of the central electrode. The sparkplug is further provided with a single or plural semi-surface ground electrodes one end of which is bonded to the above main metal shell and the other end of which is arranged opposite to the side face of the central electrode or the side face of the insulator. A semi-surface gap (B) is formed between the end face of the other end of the semi-surface ground electrode and the side face of the central electrode opposite to the end face. A semi-surface air gap (C) is formed between the end face of the semi-surface ground electrode and the side face of the insulator opposite to the end face. A difference in a level E between the height of the lower end face of the insulator and the height of the upper edge of the end face of the semi-surface ground electrode is equal to or smaller than +0.7 mm, ('+' means a direction in which the upper edge of the end face of the semi-surface ground electrode separates downward from the lower end face of the insulator). The distance B of the semi-surface gap (B) is longer than the distance A of the main air gap (A). If a first extended line acquired by extending a line showing the lower end face of the insulator outward, a second extended line acquired by extending a line showing the side face in the vicinity of the semi-surface gap (B) of the insulator in the direction of the above lower end face and a third extended line acquired by extending a line showing the end face of the semi-surface ground electrode downward are drawn respectively in case the end face of the semi-surface ground electrode and the insulator are cut along the central axis of the insulator, distance (hereinafter called the distance C of a semi-surface air gap (C) from the intersection of the first and second extended lines to the intersection of the first and third extended lines is shorter than the distance A of the main air gap (A).

The spark plug is shown so that the end face of the central electrode is located down.

As the distance A of the main air gap (A) is shorter (A<B) than the distance B of the semi-surface gap (B) by structured above, spark discharge is generated in the main air gap (A) between the central electrode and the parallel ground electrode at normal time at which no carbon fouling state is caused. The distance C of the semi-surface air gap (C) is shorter (C<A) than the distance A of the main air gap (A) and difference in a level E between the height of the lower end face of the insulator and the height of the upper edge of the end face of the semi-surface ground electrode is equal to or smaller than +0.7 mm. Therefore, in a carbon fouling state fouled by carbon generated by combustion on the lower end face of the insulator, spark discharge is generated between the edge of the semi-surface ground electrode and the side face of the central electrode via the surface of the lower end face of the insulator (hereinafter called semi-surface discharge). After spark of semi-surface discharge fly in the semi-surface air gap (C), it runs along the surface of the insulator. When semi-surface discharge is repeated some times, carbon accumulated on the lower end face of the insulator is burned off. The surface of the insulator is restored to a clean state. Insulation on the surface of the insulator is again recovered. A carbon fouling is dissolved and spark discharge is generated in not the semi-surface gap (B) but the main air gap (A).

Therefore, the present invention produces the following effect.

In the spark plug according to the present invention, spark discharge is generated in the main air gap (A) between the central electrode and the parallel ground electrode in most time. Only at the time of a carbon fouling state in which the surface of the insulator is fouled by carbon, semi-surface discharge is generated the semi-surface gap (B) with the semi-surface ground electrode and fuel mixture in a combustion chamber is ignited. As fuel mixture is ignited by spark discharge in the main air gap (A) in most time, the spark plug is excellent in ignitability. As semi-surface discharge is provided with self-cleaning action in which carbon accumulated on the surface of the insulator is burned off, the spark plug is extremely strong in a carbon fouling. Further, as the frequency in which semi-surface discharge is generated is low and the discharge time is extremely short, the action of channeling by sparks is weakened and channeling is hardly caused. Therefore, the life of this spark plug is sufficiently long.

In the present invention, the distance A of the main air gap (A), the distance B of the semi-surface gap (B) and the distance C of the semi-surface air gap (C) can be in the relationship of "$A \leqq (0.8(B-C)+C)$"mm.

When the spark plug is formed as described above, at normal time at which the spark plug is not in carbon fouling state, the rate of flying sparks in the main air gap (A) is 50% or more. Therefore, at normal time, sparks fly in the main air gap (A) and the spark plug is advantageous in consideration of ignitability and channeling.

In the present invention, the distance B of the semi-surface gap (B) can be equal to or shorter than 2.2 mm, and the distance C of the semi-surface air gap (C) is equal or longer than 0.4 mm and is equal or shorter than (A–0.1) mm (A: the distance of the main air gap (A)).

When the spark plug is thus structured, semi-surface discharge can be more securely generated between a semi-surface ground electrode and a central electrode when the surface of insulator is in a carbon fouling state. If the distance B of the semi-surface gap (B) is longer than 2.2 mm, no discharge is generated between the semi-surface ground electrode and the central electrode, and probability of so-called flashover which no discharge is generated between the semi-surface ground electrode and the central electrode, and discharge is generated along the surface of a leg portion of the insulator between the central electrode and the vicinity of a part attached to the insulator of main metal shell is caused is increased. When the distance C of the semi-surface air gap (C) is smaller than 0.4 mm, a bridge by carbon is generated between the semi-surface ground electrode and the insulator and probability in which discharge is disabled is increased. In the meantime, when the distance C of the semi-surface air gap (C) is longer than 0.1 mm which is the distance A of the main air gap (A), probability in which discharge is executed in not discharge in the semi-surface air gap (C) with the semi-surface ground electrode and the insulator but the main air gap (A) with the parallel electrode even at the time of a carbon fouling is increased.

In the present invention, difference in a level E between the height of the lower end face of the insulator and the height of the upper edge of the end face of the semi-surface ground electrode can be preferably equal to or smaller than +0.5 mm ('+' means a direction in which the upper edge of the end face of the semi-surface ground electrode separates downward from the lower end face of the insulator).

When the spark plug is structured as described above, spark cleaning action of the surface of the insulator by the sparks of semi-surface discharge can be effectively maintained. If difference in a level E between the height of the lower end face of the insulator and the height of the edge of the upper end face of the semi-surface ground electrode is larger than +0.5 mm, the sparks of semi-surface discharge reach the lower end face of the insulator and the effect of spark cleaning action of the surface of the insulator may be deteriorated.

If the above difference in a level E is decreased in one direction (that is, in a direction in which the upper edge of the end face of the semi-surface ground electrode separates upward from the lower end face of the insulator), discharge voltage may be increased in a spark plug without the parallel ground electrode.

However, as discharge voltage at normal time is determined by the parallel ground electrode in the spark plug also provided with the parallel ground electrode according to the present invention, no discharge voltage is increased. In this case, it is desirable that the cross section of the semi-surface ground electrode is 3 $mm^2$ or smaller. In the semi-surface air gap (C), the generation of a bridge at the time of a start at low temperature can be inhibited by forming as described above.

In the present invention, also, the above difference in a level E can be equal to or smaller than –0.7 mm.

Spark cleaning action on the surface of the insulator by sparks of semi-surface discharge can be further effectively maintained by forming as described above.

In the present invention, quantity H in which the central electrode is protruded from the lower end face of the insulator can be equal to or larger than 1.0 mm and is equal to or smaller than 4.0 mm.

The waste of the central electrode due to semi-surface discharge can be reduced by forming as described above. Difference between ignitability by spark discharge in the main air gap (A) with a parallel ground electrode and the ignitability of a semi-surface ground electrode by semi-surface discharge can be reduced and the variation of the torque of an internal combustion engine due to the change of ignitability according to the change of a discharge electrode can be inhibited as much as possible. When the quantity H in which the central electrode is protruded is smaller than 1.0 mm, the waste of the side face of the central electrode increases.

In the meantime, when the quantity H in which the central electrode is protruded is more than 4.0 mm, ignitability by semi-surface discharge is deteriorated, compared with ignitability in the main air gap (A), the ignitability of both is different and is not desirable. The temperature of the central electrode is too high and probability in which preignition is caused is increased.

To further reduce the difference in ignitability and further inhibit the rise of the temperature of the central electrode, it is desirable that H is equal to or smaller than 2.0 mm.

In the present invention, the diameter at the end of the central electrode can be reduced, compared with the diameter at the base protruded from the lower end face of the insulator, the diameter D1 at the end of the central electrode is equal or longer than 0.4 mm and is equal to or shorter than 1.6 mm, and the diameter D2 at the base of the central electrode protruded from the lower end face of the insulator is equal to or longer than (D1+0.3 mm).

When the diameter D1 at the end of the central electrode is reduced as described above, discharge voltage between the central electrode and a parallel ground electrode is reduced and ignitability in the main air gap (A) is enhanced. When the diameter D1 at the end of the central electrode is shorter than 0.4 mm, the waste by sparks is increased even if noble metal is used for the end of the central electrode and the spark plug is not practical. When the diameter D1 at the end of the central electrode is longer than 1.2 mm, the action of reducing discharge voltage becomes unremarkable.

When the diameter D2 at the base of the central electrode is longer than the diameter D1 at the end of the central electrode, sparks readily fly in the semi-surface gap (B) at a carbon fouling time and at normal time, sparks readily fly in the main air gap (A). Further, when the diameter D2 at the base of the central electrode is long to some extent, the action of reducing heat is activated and the end of the central electrode is prevented from being overheated. It is considered that when the diameter D2 at the base of the central electrode is equal to or longer than (D1+0.3) mm, the above effect is produced.

In the present invention, the diameter D2 at the base of the central electrode can be equal to or longer than 2.0 mm.

The end of the central electrode can be further effectively prevented from being overheated by forming so that the diameter at the base of the central electrode is long as described above and the waste of the central electrode in the case of discharge in the semi-surface gap (B) can be inhibited.

As the concentration of electric fields is reduced by extending the diameter D2 at the base of the central electrode, the rate of the generation of sparks in the semi-surface gap (B) at normal time can be reduced. For material used for the central electrode, it is desirable that nickel is used as a main component and it is further desirable that an alloy provided with the good conductivity of heat in which nickel content is 85 percentage by weight or more is used. Heat is further reduced by increasing a nickel content as described above and the waste of the central electrode in the case of discharge in the semi-surface gap (B) can be further inhibited. When the main air gap (A) is widened in case the semi-surface gap (B) is fixed, discharge in the semi-surface gap (B) is increased. Considering the waste of the central electrode, the wider the main air gap is made, the more desirable it is, however, it is considered that discharge in the semi-surface gap is also related to the width of the main air gap (A). Currently, relationship between both is not defined, however, it is desirable that the diameter D2 at the base of the central electrode is set to approximately the double of the distance A of the main air gap (A) or longer.

In the present invention, the end of the central electrode can be made of noble metal the melting point of which is 1600° C. or more such as a platinum alloy and an iridium alloy. By structured above, the wear resistance to spark discharge of the central electrode is enhanced and the life of the spark plug is extended. In this case, it is desirable that the material the particularly above nickel content of which is 85 percentage by weight or more of the central electrode is used. Hereby, as the heat at the end of the central electrode is reduced and the temperature of the iridium alloy the waste by oxidation of which is much particularly at high temperature can be lowered, it is very advantageous to the waste of noble metal.

In the present invention, the semi-surface ground electrode can be a straight pole and the side of the semi-surface ground electrode is bonded to the lower end face of the main metal shell.

As the semi-surface ground electrode is located in the vicinity of the lower end face of insulator, the following problem may be caused if the dimension in which the insulator is protruded from the lower end face of the main metal shell is small. That is, the semi-surface ground electrode is bonded to the lower end face of the main metal shell by welding and others, however, the vicinity of the bonded part is required to be bent in the approximately shape of a letter L on the side of the central electrode. Therefore, the curvature of the bent part is required to be reduced and manufacturing problems such as breakage and a crack may be caused. Therefore, such problems can be solved by forming according to the present invention.

Preferred embodiments according to the present invention will be described as follows referring to the accompanying drawings.

Referring to the drawings, a first embodiment of the present invention will be described.

FIG. 1 is a partial sectional view showing a spark plug equivalent to the first embodiment. Insulator 1 made of alumina and others is provided with corrugations 1A to extend surface distance in the upper part and a leg portion 1B exposed to the combustion chamber of an internal combustion engine in the lower part and a central through hole 1C in the axial center. At the lower end of the central through hole 1C, a central electrode 2 made of a nickel alloy such as Inconel is held in a state that the central electrode 2 is protruded downward from the lower surface of the insulator 1. The central electrode 2 is electrically connected to an upper terminal nut 4 via a ceramic resistor 3 provided inside the central through hole 1C. A high-tension cable not shown in FIG. 1 is connected to the terminal nut 4 and high voltage is applied to the terminal nut. The above insulator 1 is supported by main metal shell 5 with the insulator surrounded by the main metal shell. The main metal shell 5 is made of low-carbon steel and is composed of a hexagonal part 5A for engaging with a spark plug wrench and a thread part 5B. The main metal shell 5 is staked to the insulator 1 by its staking part 5C and the main metal shell 5 and the insulator 1 are integrated. To complete sealing by staking, a disc packing member 6 and sealing members 7 and 8 in the shape of wire are inserted between the main metal shell 5 and the insulator 1 and talc powder 9 is filled between the sealing members 7 and 8. A gasket 10 is fitted to the upper end of the thread part 5B.

A parallel ground electrode 11 made of a nickel alloy is bonded to the lower end of the main metal shell 5 by welding. The parallel ground electrode 11 is axially opposed to the end face of the central electrode 2, and the central electrode 2 and the parallel ground electrode 11 form a main air gap (A).

The spark plug according to this embodiment is provided with two semi-surface ground electrodes 12 in addition to the parallel ground electrode 11. The semi-surface ground electrode 12 is made of a nickel alloy, one end is bonded to the lower end of the main metal shell 5 by welding and the end face 12C of the other end is opposed to the side face 2A of the central electrode 2 or the side face 1E of the leg portion 1B. The two semi-surface ground electrodes 12 are respectively arranged in a position off by 90° from the parallel ground electrode 11 and each semi-surface ground electrode 12 is arranged in a position off by 18020 from each other. The end face 12C of each semi-surface ground electrode 12 and the side face 2A of the central electrode 2 form a semi-surface gap (B), and the end face 12C of each semi-surface ground electrode 12 and the side face 1E of the leg portion 1B form a semi-surface air gap (C).

Figure 2A:
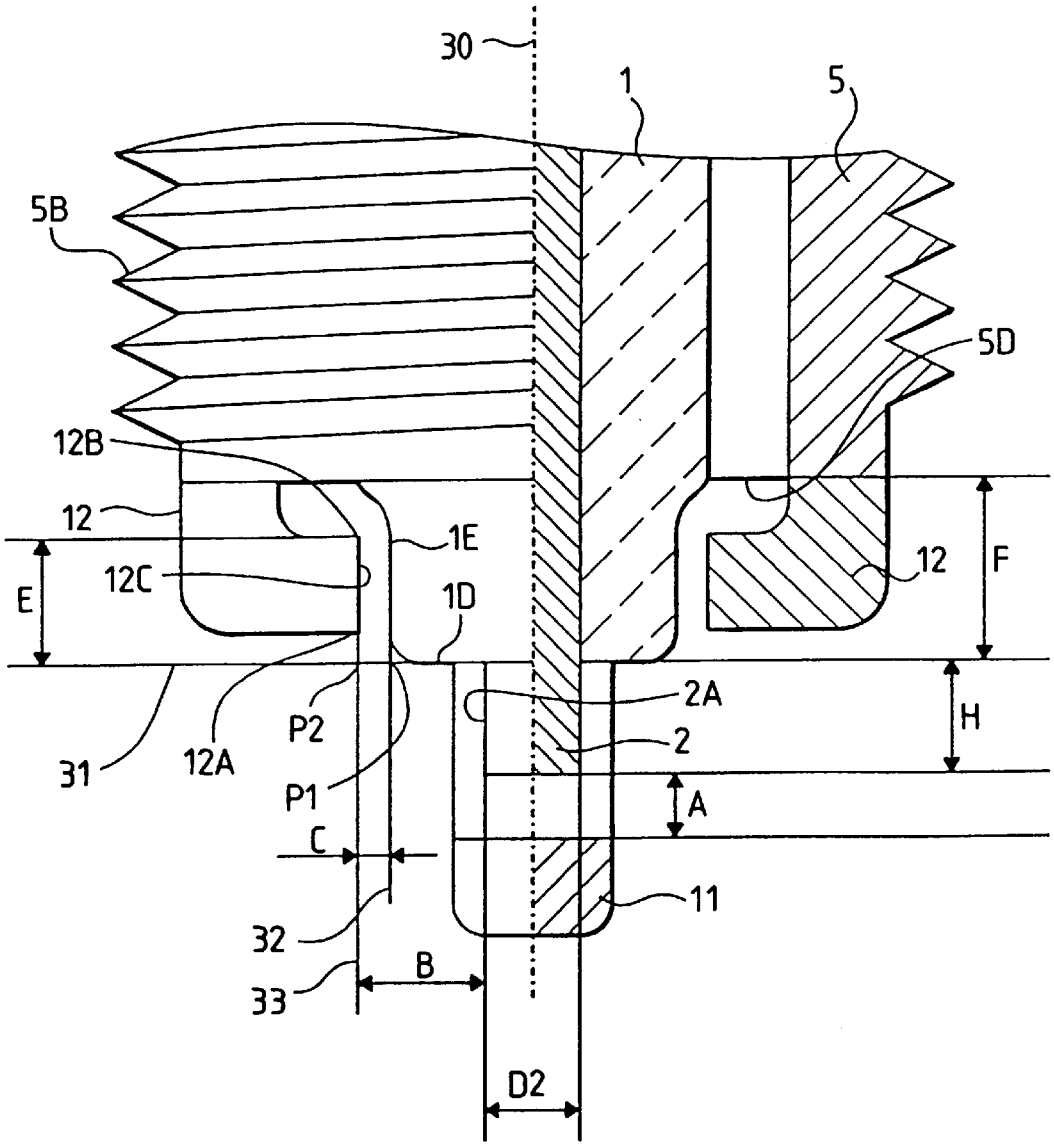
FIG. 2A is a partial sectional view showing an enlarged vicinity of an electrode of a spark plug equivalent to a first embodiment.
Figure 2B:
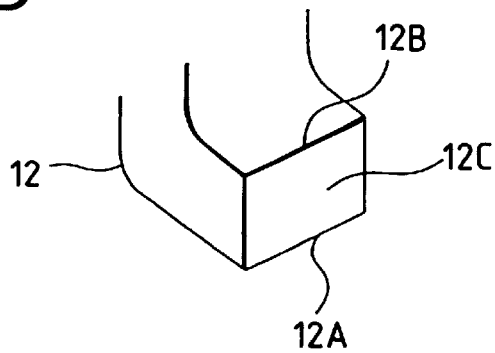
FIG. 2B is an explanatory drawing showing an enlarged semi-surface ground electrode 12.

FIG. 2A is a partial sectional view showing the enlarged vicinity of the central electrode 2, the parallel ground electrode 11 and the semi-surface ground electrode 12 of the spark plug. FIG. 2B is an explanatory drawing showing the enlarged semi-surface ground electrode 12.

The distance of the main air gap (A) between the end face of the central electrode 2 and the parallel ground electrode 11 is A. The distance of the semi-surface gap (B) between the side face 2A of the central electrode 2 and the end face 12C of the semi-surface ground electrode 12 is B. A first extended line 31 is acquired by extending a line showing the lower end face 1D of the insulator 1 outward. A second extended line 32 is acquired by extending a line showing the side face 1E in the vicinity of the semi-surface gap (B) of the insulator 1 in the direction of the lower end face 1D. A third extended line 33 is acquired by extending a line showing the end face 12C of the semi-surface ground electrode 12 downward. These lines are drawn in case the semi-surface ground electrode 12 and the insulator 1 are cut along a central axis 30 and distance from the intersection P1 of the first extended line 31 and the second extended line 32 to the intersection P2 of the first extended line 31 and the third extended line 33 is the distance C of the semi-surface air gap (C), A is shorter than B and C is shorter than A.

By setting as described above, at normal time when the insulation of the surface of the insulator 1 is high, discharge can be made via the main air gap (A) between the insulator and the parallel ground electrode 11. Alternatively, when the insulation of the surface of the insulator 1 is deteriorated, discharge can be made via the semi-surface gap (B) between the insulator and the semi-surface ground electrode 12. The difference in a level between the lower end face 1D of the insulator 1 and the upper edge 12B of the end face 12C of the semi-surface ground electrode 12 is E. The quantity in which the insulator 1 is protruded from the lower end face 5D of the main metal shell 5 shall is F. The quantity in which the central electrode 2 is protruded from the lower end face 1D of the insulator 1 is H.

In this embodiment, the quantity F in which the insulator 1 is protruded is set to 3.0 mm. The diameter D2 of the central electrode 2 is set to 2.0 mm. The semi-surface ground electrode having the width of 2.2 mm and the thickness of 1.3 mm is used. The parallel ground electrode 11 having the width of 1.5 mm and the thickness of 2.8 mm is used. The parallel ground electrode 11 provided with a copper core may be also used to lower the temperature of the end and prevent a spark from being wasted.

Figure 3:
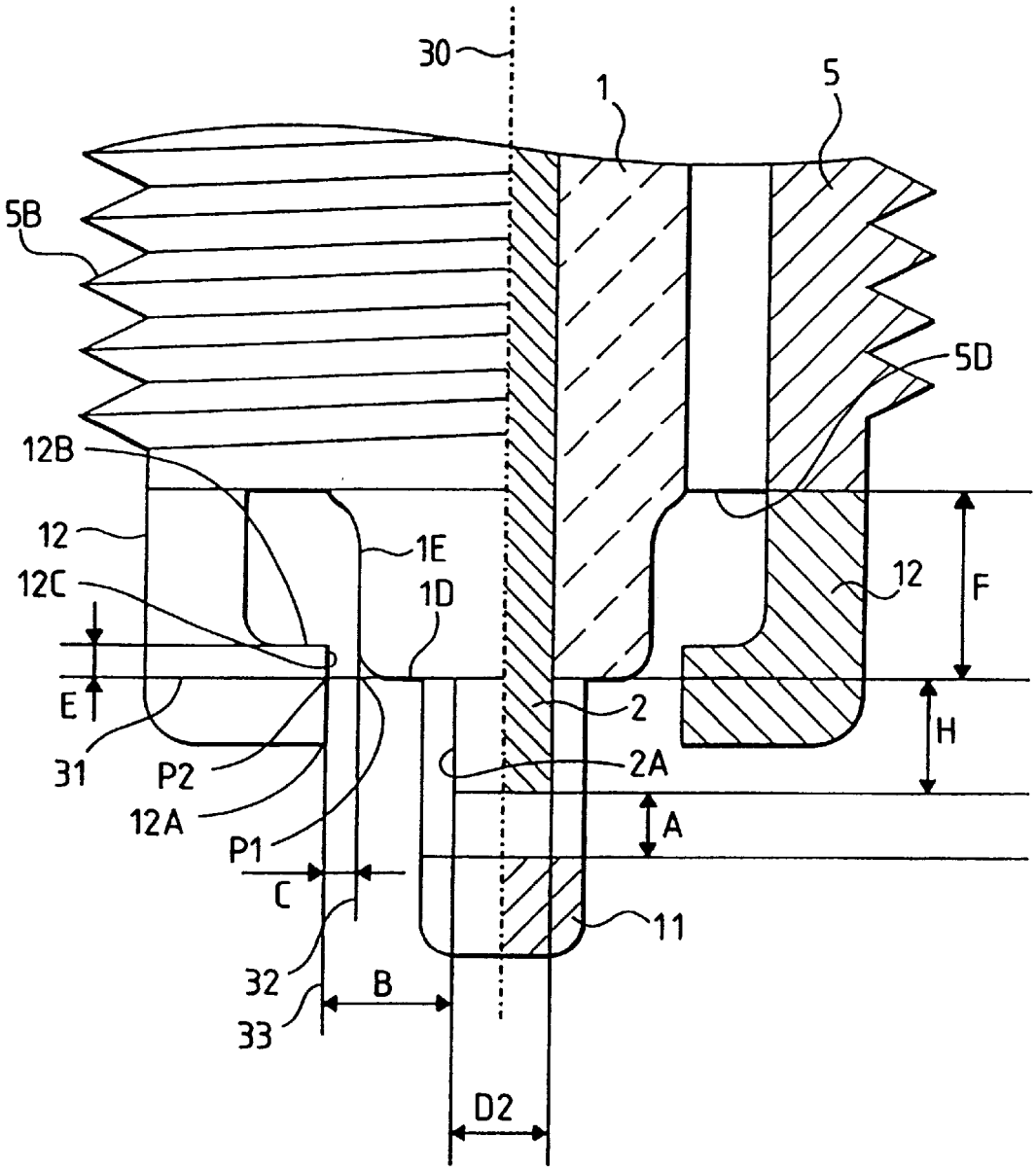
FIG. 3 is a partial sectional view showing an enlarged vicinity of an electrode of a spark plug equivalent to a second embodiment.
Figure 4:
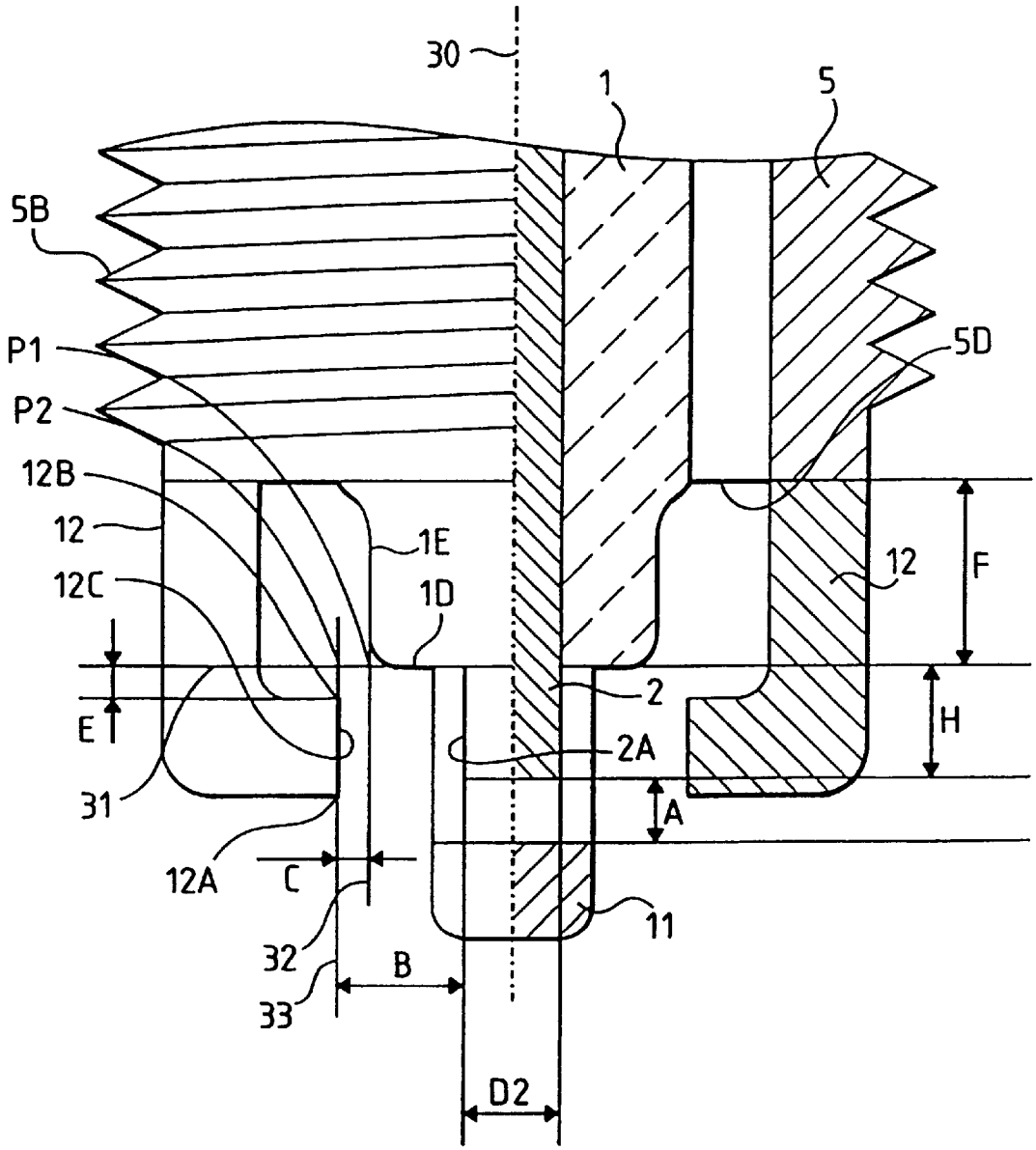
FIG. 4 is a partial sectional view showing the enlarged vicinity of an electrode of a spark plug equivalent to a third embodiment.

As for the difference in a level E between the height of the lower end face 1D of the insulator 1 and the height of the upper edge 12B of the end face 12C of the semi-surface ground electrode 12, there are three following cases. First, the upper edge 12B and the lower edge 12A respectively shown in FIG. 2B of the semi-surface ground electrode 12 are located higher than the lower end face 1D of the insulator 1 as shown in FIG. 2(*a*). Second, only the upper edge 12B of the semi-surface ground electrode 12 is located higher than the lower end face 1D of the insulator 1 as shown in FIG. 3. Third, the upper edge 12B of the semi-surface ground electrode 12 is located lower than the lower end face 1D of the insulator 1 as shown in FIG. 4 respectively depending upon the height of the semi-surface ground electrode 12.

In any case, it is desirable that either of the upper edge 12B and the lower edge 12A of the end face 12C of the semi-surface ground electrode 12 is located at the height of the vicinity of the lower end face 1D of the insulator 1. That is, it is desirable that the difference in a level E is small. The reason is that sparks which fly from the upper edge 12B and the lower edge 12A are brought close to the lower end face 1D of the insulator 1 and self-cleaning action in which carbon which accumulates on the surface of the insulator 1 is burned is enhanced because semi-surface discharge is made at an acute angle. Accordingly, it is considered that sparks fly from the upper edge 12B and the lower edge 12A of the semi-surface ground electrode 12 in which electric fields concentrate.

(Grounds that B is equal to or shorter than 2.2 mm)

Figure 5:
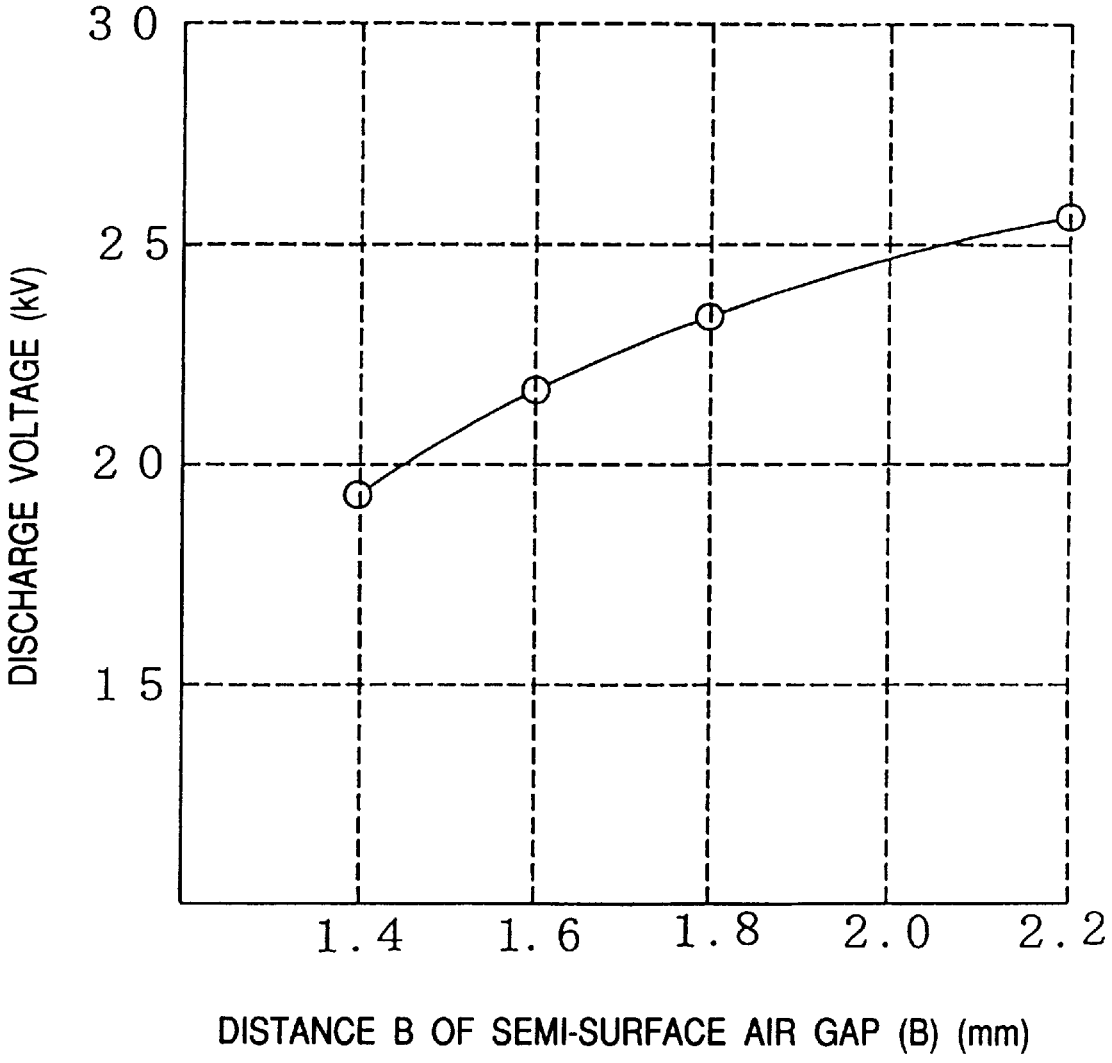
FIG. 5 is a graph showing relationship between the distance B of a semi-surface gap (B) and discharge voltage.

FIG. 5 is a graph showing relationship between the distance B of the semi-surface gap (B) and discharge voltage. To evaluate the relationship between the distance B of the semi-surface gap (B) and discharge voltage, a test from idling to racing in which an engine was operated and racing was made by opening a throttle wide from the state of idling to observe discharge voltage was made. For a spark plug, the one the parallel ground electrode 11 of which is cut in a part welded to the main metal shell 5 is used. Also, a straight 4-cylinder engine provided with the displacement of 1.6 l. is used. When the distance B of the semi-surface gap (B) exceeds 2.2 mm, discharge voltage exceeds 25 kV and so-called flashover in which sparks fly from the central electrode 2 to the vicinity of the base of the leg portion 1B of the insulator 1 of the main metal shell 5 before discharge is generated between the semi-surface ground electrode 12 and the central electrode 2 may be caused. Therefore, it is required that the distance B of the semi-surface gap (B) is 2.2 mm or less.

(Grounds that $A \leqq (0.8(B-C)+C)$mm and $0.4 \leqq C \leqq (A-0.1)$mm)

Figure 6:
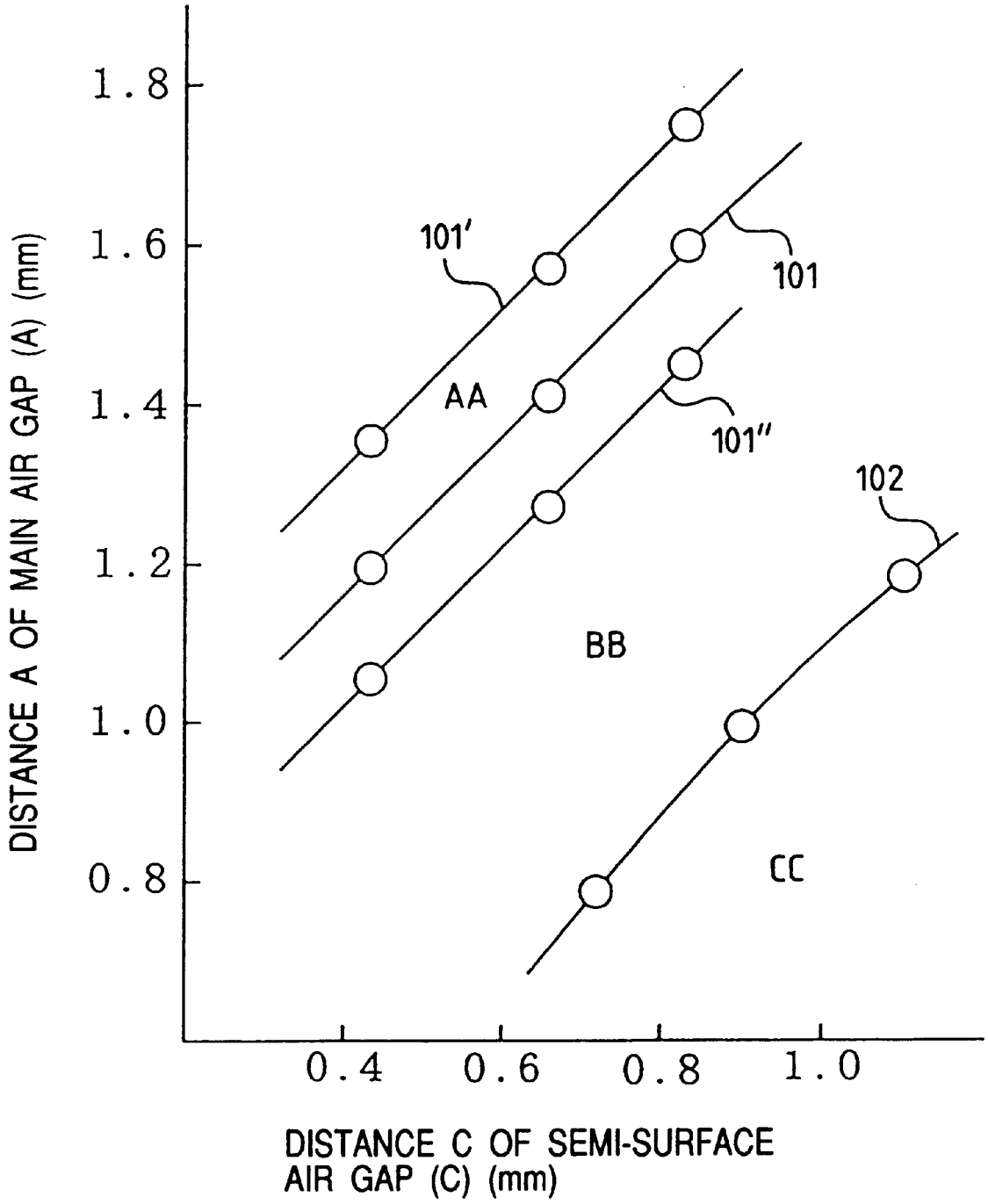
FIG. 6 is a graph showing the rate of flying sparks of 50% where points at which the rate of flying sparks in a main air gap (A) and a semi-surface air gap (C) is respectively 50% are plotted wherein the y-axis shows the distance A of the main air gap (A) and the x-axis shows the distance C of the semi-surface air gap (C)

In FIG. 6, the y-axis shows the distance A of the main air gap (A), the x-axis shows the distance C of the semi-surface air gap (C). FIG. 6 is a graph showing the rate of flying sparks of 50% in which points where the rate of flying sparks in the main air gap (A) and the semi-surface air gap (C) is respectively 50% are plotted. The rate of flying sparks is evaluated by an armchair test in which the direction of flying sparks is observed by installing the spark plug in a chamber provided with a window from which the main air gap (A) and the semi-surface gap (B) can be observed. For the spark plug in a carbon fouling state, a sample the insulation resistance value of which is lowered up to 5 to 10 MΩ using a general-purpose engine and others beforehand is prepared. In FIG. 6, a straight line 101 shows the rate of flying sparks of 50% measured at normal time when the spark plug is not in a carbon fouling state in case the part of the lower end face 1D of the insulator 1 in the semi-surface gap (B). That is, the difference (B−C) between the distance B of the semi-surface gap (B) and the distance C of the semi-surface air gap (C) is 1.0 mm, a straight line 101' similarly shows the rate of flying sparks of 50% in case the above difference (B−C) is 1.2 mm and a straight line 101" similarly shows the rate of flying sparks of 50% in case the difference (B−C) is 0.8 mm.

In a carbon fouling state, independent of the magnitude of the distance B of the semi-surface gap (B), the rate of flying sparks of 50% is shown by the same straight line. Therefore, if the above difference (B−C) is 1.0 mm, for example, an area AA on the left side of the straight line 101 is an area in which sparks also fly in the semi-surface air gap (C) at normal time and areas BB and CC on the right side of the straight line 101 are areas in which sparks fly in the main air gap (A) at normal time. In the meantime, areas AA and BB on the left side of the straight line 102 are areas in which sparks fly in the semi-surface air gap (C) at carbon fouling time and an area CC on the right side of the straight line 102 is an area in which sparks also fly in the main air gap (A) at carbon fouling time. Therefore, an area in which sparks fly in the main air gap (A) at normal time and sparks fly in the semi-surface air gap (C) at carbon fouling time is the area BB between the two straight lines 101 and 102.

As the straight line 101 is expressed by C=A−0.8 mm, and the straight line 102 is expressed by C=A−0.1, the area BB between the straight lines 101 and 102 is expressed by the following expression (1).

$$A-0.8 \leqq C \leqq A-0.1 \text{ (mm)} \quad (1)$$

The straight line 101' acquired by linearly regressing data in case the above difference (B−C) is 1.2 mm is expressed by C=A−0.96 and the straight line 101" acquired by linearly regressing data in case the difference (B−C) is 0.8 mm is expressed by C=A−0.64. Therefore, if the above three types of straight lines 101, 101' and 101" are compared, it is known that a condition in the following expression (2) is required so that the rate of flying sparks in the main air gap (A) at normal time in consideration of the semi-surface gap (B) is 50% or more.

$$A \leqq 0.8(B-C)+C(\text{mm}) \quad (2)$$

On the other hand, it proves that if the distance C of the semi-surface air gap (C) is too small, the spark plug is weak in so-called pre-delivery fouling. The pre-delivery fouling means fouling in which the temperature of a spark plug does not rise and the spark plug becomes a carbon fouling state because a new car is driven by extremely short distance many times from the assembly factory of cars to a dealer and the insulation resistance of the spark plug is deteriorated. To evaluate pre-delivery fouling, a method of locating a car in a low-temperature test room of −10° C. as defined in a low-load compatibility test in JIS D 1606, operating it by 10 cycles having a predetermined operation pattern including inching a few times at low speed as one cycle and measuring the insulation resistance value of a spark plug at the middle and the end of each cycle is taken.

Figure 7:
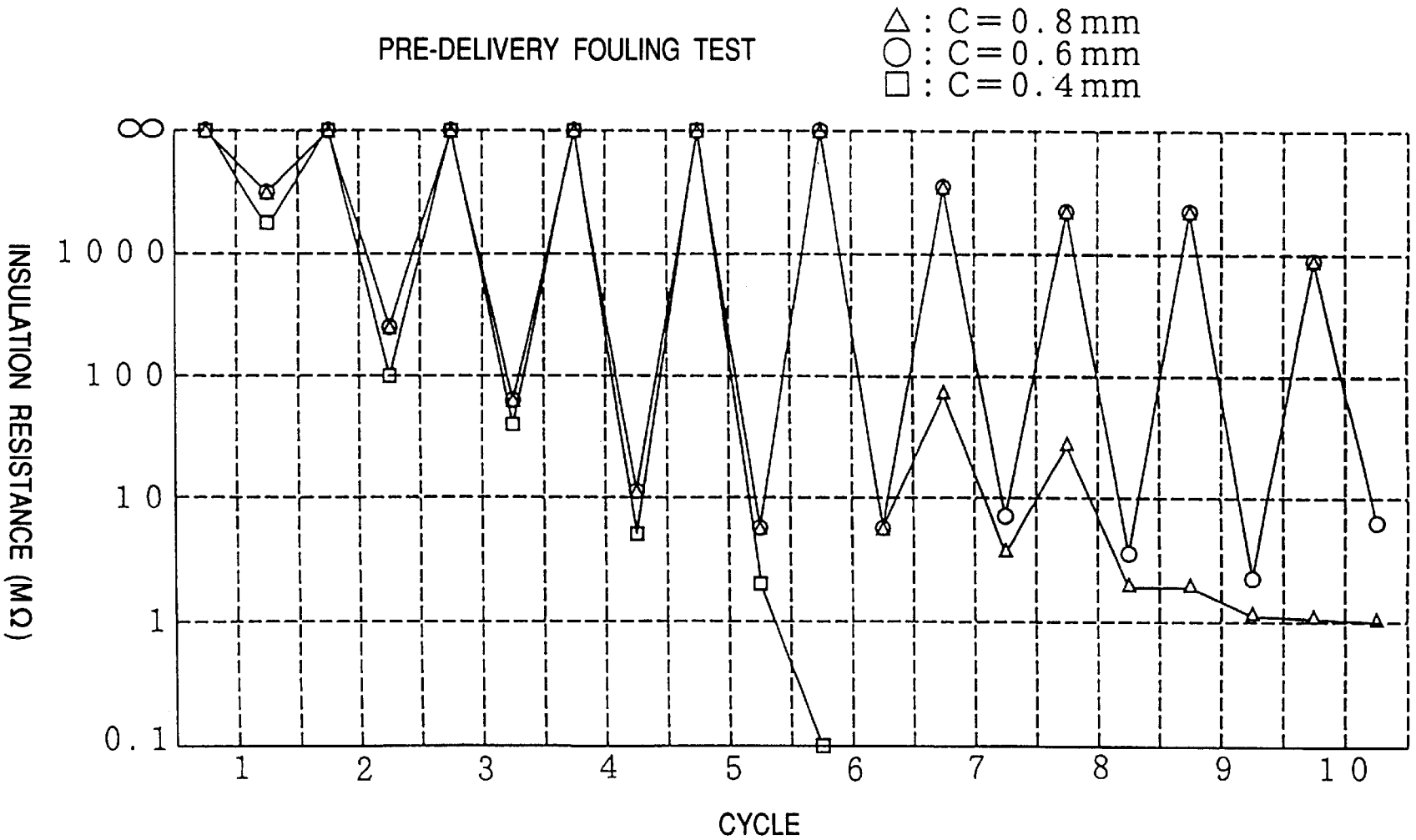
FIG. 7 is a graph showing examples of measurement in a pre-delivery fouling text.

FIG. 7 shows an example of a pre-delivery fouling test of spark plugs different in the distance C of the semi-surface air gap (C). In FIG. 7, □ shows the insulation resistance measured value of a double-pole semi-surface spark plug when C is 0.4 mm, ○ shows the above value when C is 0.6 mm and Δ shows the above value when C is 0.8 mm. For an engine, a straight 6-cylinder engine provided with the displacement of 2.5 l. is used. When C is 0.4 mm, a carbon bridge is caused in six cycles, discharge is disabled and an engine stall is caused.

Figure 8:
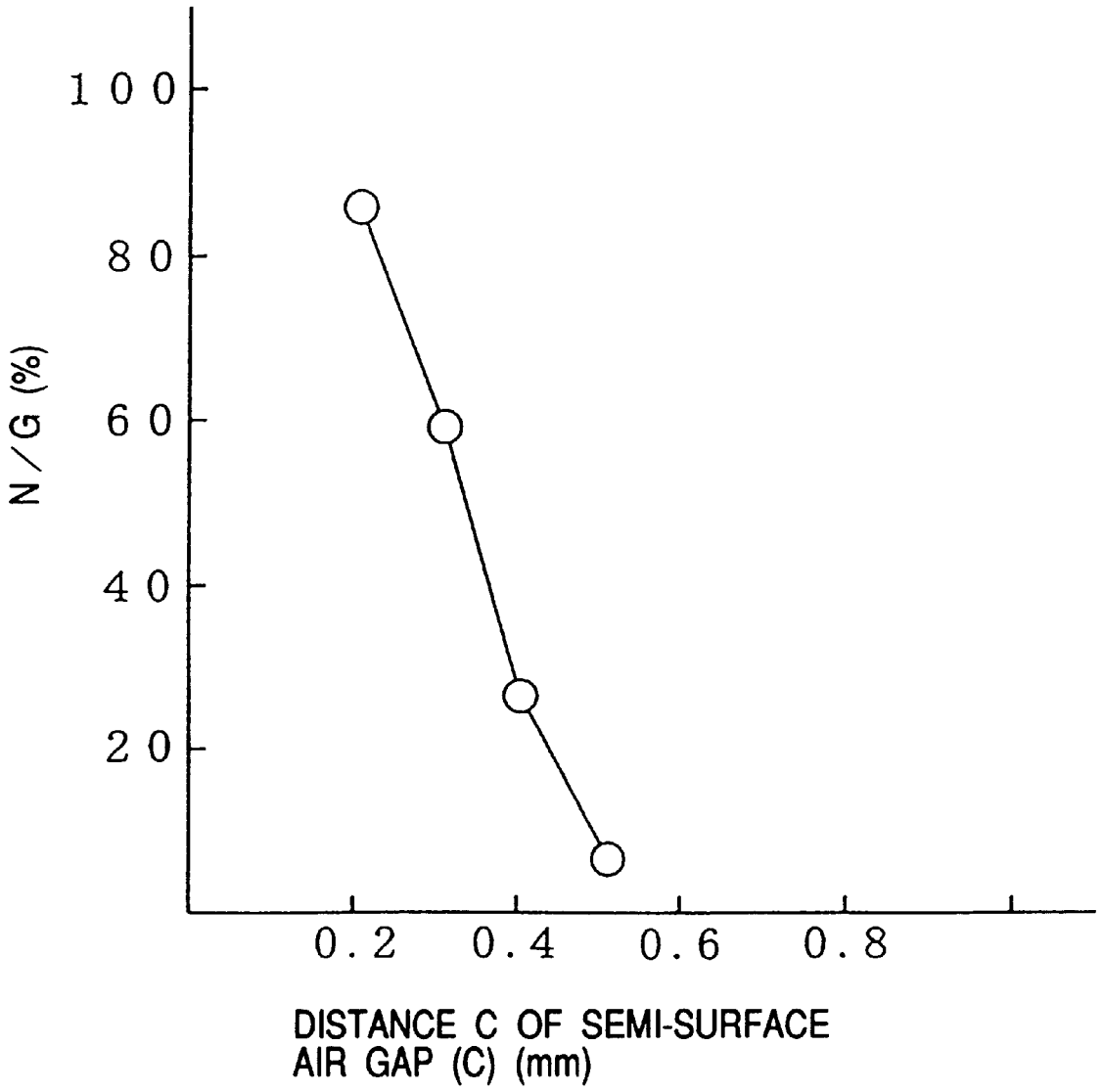
FIG. 8 is a graph showing relationship between the distance C of the semi-surface air gap (C) and an undesirable result in the pre-delivery fouling test.

FIG. 8 shows the approximate probability of failure in which the above pre-delivery fouling test is made some times, a carbon bridge is caused and an engine stall is caused and the x-axis shows the distance C of the semi-surface air gap (C). As clear from FIG. 8, when the distance C of the semi-surface air gap (C) is smaller than 0.4 mm, probability in which failure occurs rapidly increases. Therefore, the distance C of semi-surface air gap (C) is required to meet the following expression (3)(unit: mm).

$$0.4 \leqq C(\text{mm}) \quad (3)$$

As clear from the conditions in the expressions (1) and (3), it is desirable that the distance C of the semi-surface air gap (C) meets at least the following expression (4).

$$0.4 \leqq C \leqq A-0.1 \quad (4)$$

(Grounds that E≦+0.7 mm, desirably E≦+0.5 mm)

It is desirable that the difference in a level E between the lower end face 1D of the insulator 1 and the upper edge 12B of the semi-surface ground electrode 12 is +0.7 mm or less and it is preferable that it is +0.5 mm or less. In the above description, '+' means a direction in which the upper edge 12B of the end face 12C of the semi-surface ground electrode 12 separates from the lower end face 1D of the insulator 1 downward. To test in relation to difference in a level, the above pre-delivery fouling test in case the difference in a level E was minus as shown in FIG. 2A and in case the difference in a level E was plus as shown in FIG. 4 was made. A straight 4-cylinder engine provided with the displacement of 1.8 liter. was used. As a result, the result shown in the following table 1 of the test was acquired. In the table, ◎ shows a case that the spark plug also maintains the insulation resistance value of 10 MΩ or more after the operation of 12 cycles, ○ shows a case that the spark plug also maintains the insulation resistance value of 10 MΩ or more after the operation of 10 cycles, Δ shows a case that the operation of 10 cycles is still enabled though the insulation resistance value decreases up to 10 MΩ or less and x shows a case that the starting of the engine in 8 cycles is disabled.

TABLE 1

| Dimension of E | Resistance to fouling |
|---|---|
| −1.0 | ◎ |
| −0.7 | ◎ |
| −0.5 | ○ |
| 0.0 | ○ |
| +0.2 | ○ |
| +0.5 | ○ |
| +0.7 | Δ |
| +1.0 | x |

To enable the operation of 10 cycles in this test, the difference in a level E has only to be +0.7 mm or less (E≦+0.7) as clear from the above table 1 and it is desirable that the difference in a level E is +0.5 mm or less (E≦+0.5). Incidentally, it is not preferable that the dimension of E is too small. If the dimension of E is made too small, the distance of the semi-surface discharge becomes long, the discharge voltage bocomes high, and sparks are hard to fly. Accordingly, it is difficult to eliminate carbon fouling. Further, it is considered that the reason why pre-delivery resistance to fouling is deteriorated when the difference in a level E is larger than +0.7 mm is that sparks from the semi-surface ground electrode 12 separate from the lower end face 1D of the insulator 1 when the difference in a level E is increased and self-cleaning action in which carbon is burned by semi-surface discharge is deteriorated.

(Grounds that 1.0≦H≦4.0 mm)

First, it is desirable that quantity H in which the central electrode 2 is protruded from the lower end face 1D of the insulator 1 is 1.0 mm or more (1.0≦H mm).

Figure 9A:
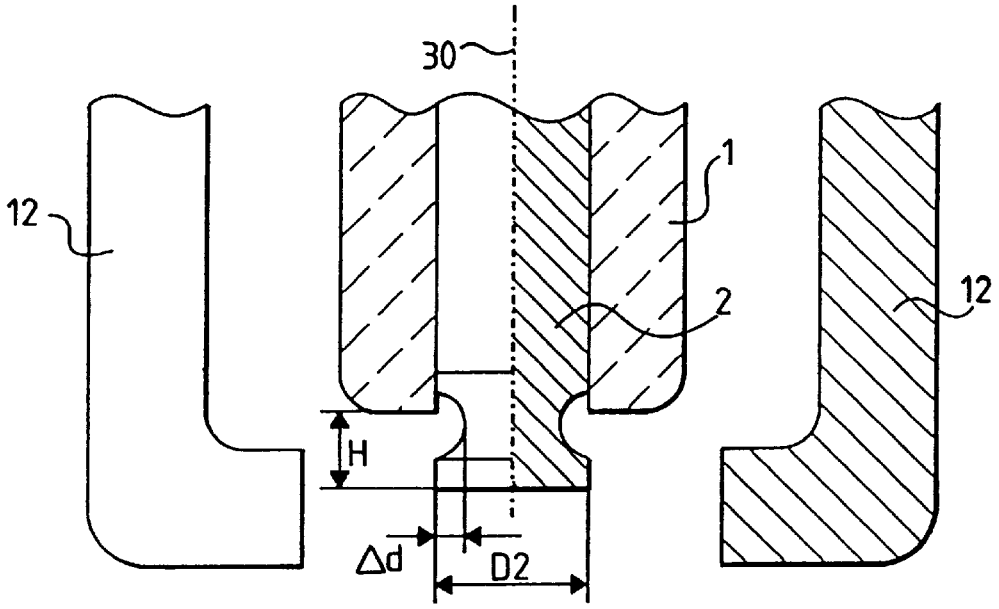
FIGS. 9A and 9B are explanatory drawings showing a state in which a central electrode is wasted.
Figure 9B:
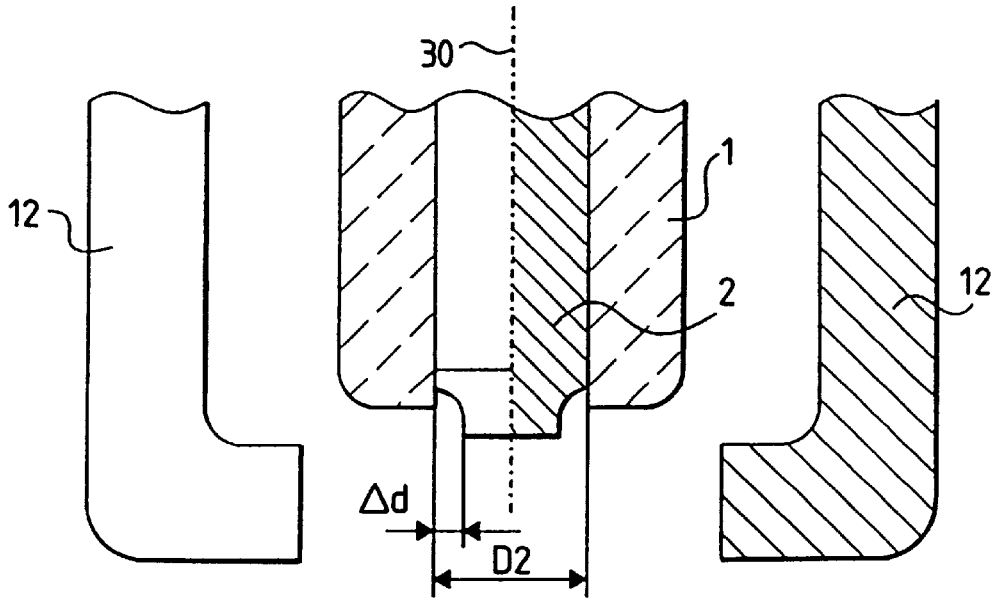

When in a spark plug in which the quantity H in which the central electrode 2 is protruded is small, semi-surface discharge from the semi-surface ground electrode 12 is generated, the sparks are concentrated in the vicinity of the lower end face 1D of the insulator 1 out of the side face 2A of the central electrode 2 and the vicinity is wasted. If the quantity H in which the central electrode 2 is protruded from the lower end face 1D of the insulator 1 is 1.0 mm or more, the side face 2A of the central electrode 2 is dented as shown in FIG. 9A. However, if the quantity H in which the central electrode 2 is protruded from the lower end face 1D of the insulator 1 is smaller than 1.0 mm, the central electrode 2 is gradually narrowed in the direction of the end face as shown in FIG. 9B.

Figure 10:
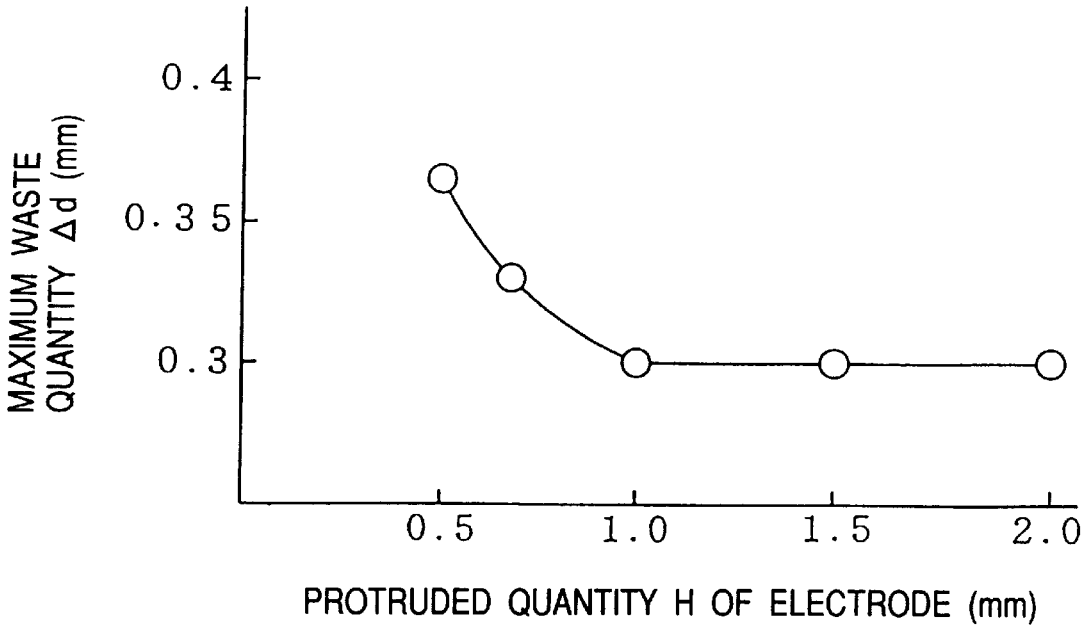
FIG. 10 is a graph showing relationship between quantity H in which the central electrode is protruded and the maximum wasted quantity $\Delta d$.

The maximum value of quantity in which the side face 2A of the central electrode 2 is wasted shall be Δd. As it is considered that the volume of an electrode wasted per one spark is approximately fixed, the maximum wasted quantity Δd in case the side face of the central electrode is wasted as shown in FIG. 9B is larger than the maximum wasted quantity Δd in case the side face is wasted as shown in FIG. 9A. To examine relationship between the maximum wasted quantity Δd and the protruded quantity H, spark plugs different in the protruded quantity H were prepared and semi-surface discharge from the semi-surface ground electrode 12 was respectively made '$4\times10^7$' times (forty million times) to examine resistance to sparks. FIG. 10 shows the result. As clear from FIG. 10, if the protruded quantity H was 0.5 mm, the maximum wasted quantity Δd was 0.37 mm, if the protruded quantity H was 0.7 mm, the maximum wasted quantity Δd was 0.33 mm, if the protruded quantity H was 1.0 mm, the maximum wasted quantity Δd was 0.30 mm and even if the protruded quantity H was further increased, the maximum wasted quantity Δd was approximately fixed. Therefore, it is desirable that the quantity H in which the central electrode 2 is protruded is 1.0 mm or more (1.0≦H mm) to reduce the maximum wasted quantity Δd.

Each parallel ground electrode 11 of the spark plugs used for this test is cut on the face welded to the main metal shell 5. Hereby, the wasted quantity was examined by always flying sparks in the semi-surface gap (B). This test was executed by installing the above spark-plugs in a chamber provided with a window via which the main air gap (A) and the semi-surface gap (B) can be observed. A general breakerless transistor igniter the spark discharge energy of which was approximately 70 mJ was used for the test.

Next, it is desirable that the quantity H in which the central electrode 2 is protruded from the lower end face 1D of the insulator 1 is 4.0 mm or less (H≦4.0 mm). There are two reasons for it.

Figure 11:
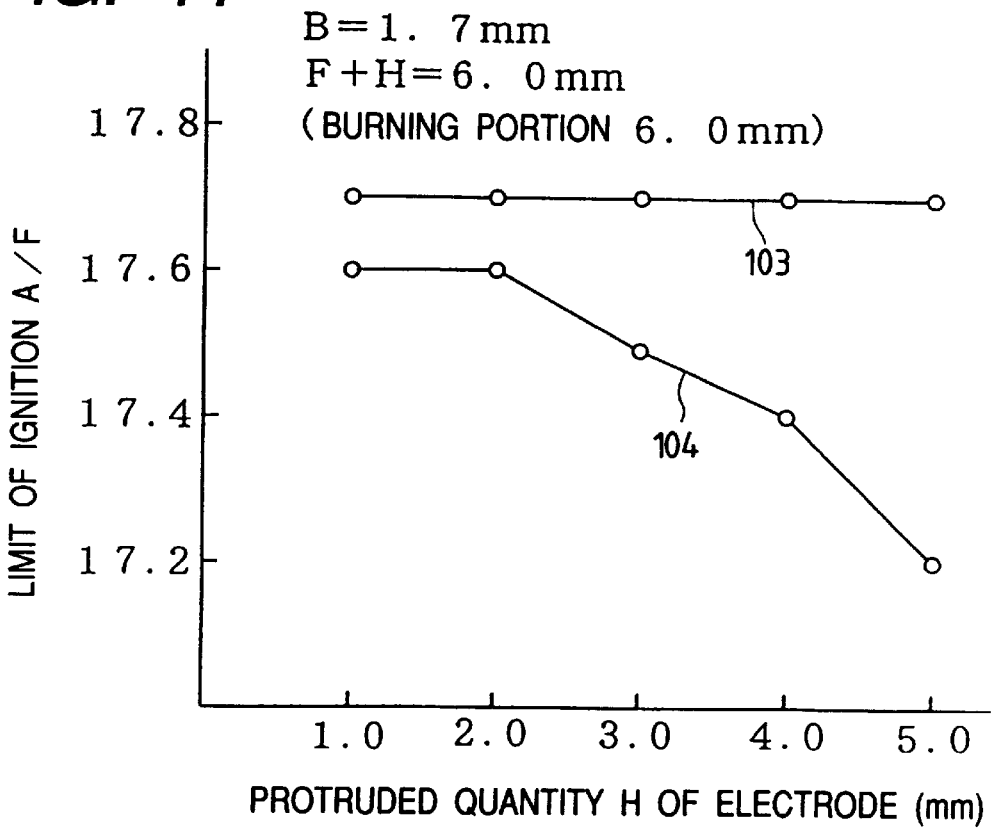
FIG. 11 is a graph showing relationship between the quantity H in which the central electrode is protruded and air-fuel ratio (A/F) to be the limit of ignition.

A first reason is that large difference should not be made in ignitability by discharge in the main air gap (A) and discharge in the semi-surface gap (B). FIG. 11 is a graph showing relationship between the protruded quantity H of the central electrode 2 in case the dimension in which the central electrode 2 is protruded from the end face 5D of the main metal shell 5 is fixed and air-fuel ratio (A/F) to be the limit of ignition. Air-fuel ratio (A/F) to be the limit of ignition is set to air-fuel ratio (A/F) the ratio of lost fire of which is 1%. A curve 103 shows air-fuel ratio to be the limit of ignition by a spark in the main air gap (A) and a curve 104 show air-fuel ratio to be the limit of ignition by a spark in the semi-surface gap (B). A straight 6-cylinder engine provided with the displacement of 2 liter, is used and the above air-fuel ratio is measured at the idle operation of 700 rpm. The dimension (F+H) in which the central electrode 2 of the spark plug is protruded from the end face 5D of the main metal shell 5 is set to 6.0 mm and the distance B of the semi-surface gap (B) is set to 1.7 mm. As main discharge in the main air gap (A) is essentially not influenced by the protruded quantity H of the central electrode 2, the curve 103 becomes a flat straight line. In the meantime, as in semi-surface discharge, the position of a spark approaches the wall of a combustion chamber as the protruded quantity H is increased, ignitability is deteriorated and the curve 104 becomes a curve the right side of which lowers. If there is large difference between ignitability in main discharge and ignitability in semi-surface discharge, the torque of an engine varies when discharge in the main air gap (A) is switched to discharge in the semi-surface gap (B) and it is not desirable. To keep the difference in ignitability in tolerance, it is desirable that the protruded quantity H of the central electrode 2 is 4.0 mm or less (H≦4.0 mm).

Figure 12:
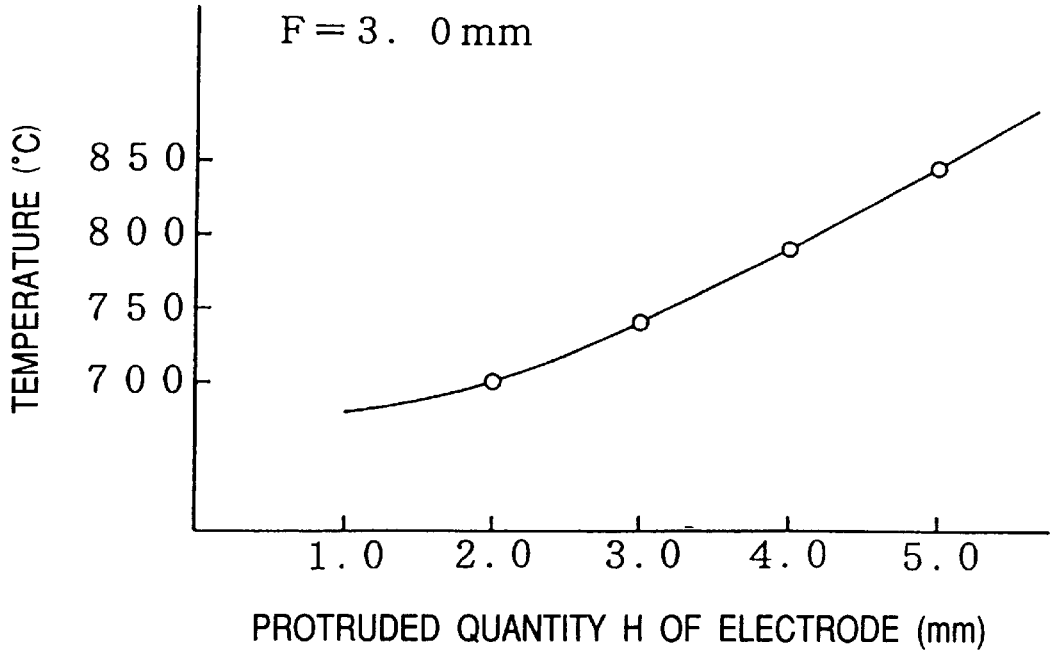
FIG. 12 is a graph showing the quantity H in which the central electrode is protruded and the temperature at the end of the central electrode.

A second reason is to prevent preignition due to the overheat of the central electrode 2. FIG. 12 is a graph showing relationship between the protruded quantity H of the central electrode 2 and the temperature of the central electrode 2. The protruded quantity F of the insulator 1 is 3.0 mm and a spark plug the heat value of which is 5 is used. When the protruded quantity H of the central electrode 2 is increased, the reduction of heat by the insulator 1 is deteriorated and the temperature at the end of the central electrode 2 becomes high. If the protruded quantity H is 5.0 mm, the temperature at the end of the central electrode 2 exceeds 850° C. and preignition may be caused. Therefore, it is desirable that the protruded quantity H of the central electrode 2 is 4.0 mm or less (H≦4.0 mm).

For the above reasons, it is desirable that the quantity H in which the central electrode 2 is protruded from the lower end face 1D of the insulator 1 is 1.0≦H≦4.0 mm.

Next, referring to the drawings, a second embodiment of the present invention will be described. As this embodiment is the same as the above first embodiment except the shape of the end of a central electrode 2, the description is omitted and only a different part will be described below.

Figure 13:
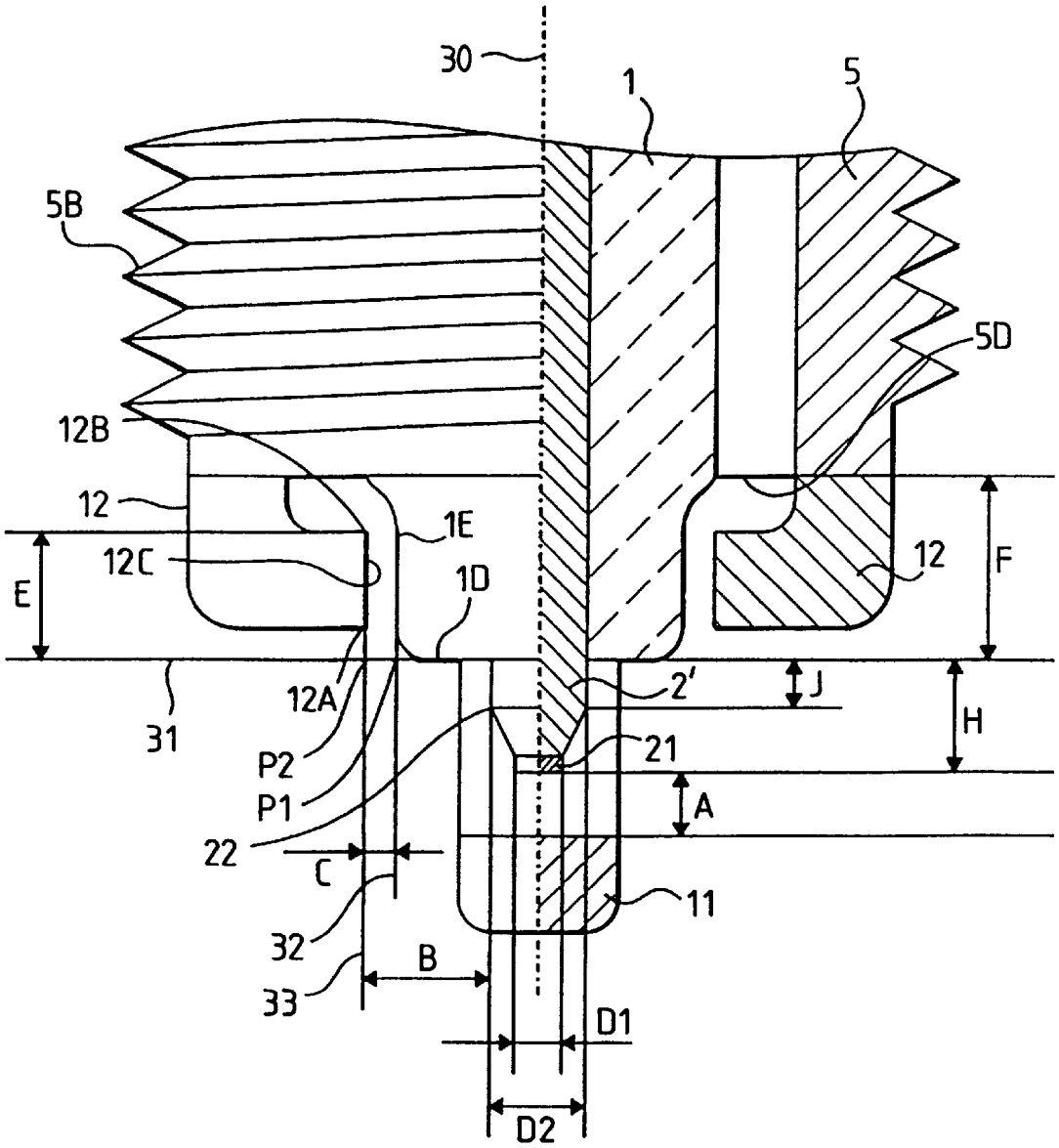
FIG. 13 is a partial sectional view showing the enlarged vicinity of an electrode of a spark plug equivalent to a second embodiment.

FIG. 13 is a partial sectional view showing an enlarged vicinity of a central electrode 2', a parallel ground electrode 11 and a semi-surface ground electrode 12 respectively of a spark plug. The diameter of the end of the central electrode 2' is reduced, compared with the base protruded from the lower end face 1D of insulator 1. The diameter of the end of the central electrode 2' is D1 and the diameter of the base is D2. A chip 21 made of a platinum alloy is bonded to the end of the central electrode 2' the diameter of which is reduced by laser beam welding.

In this embodiment, quantity H in which the central electrode 2' is protruded from the lower end face 1D of the insulator 1 is set to 2.0 mm and quantity J in which the central electrode 2' is protruded from the lower end face 1D of the insulator 1 at a starting point 22 from which the reduction of the diameter of the central electrode 2' is started is set to 0.6 mm.

(Grounds that 0.4≦D1≦1.6 mm)

It is desirable that the diameter D1 at the end of the central electrode 2' is 0.4 mm or more and 1.6 mm or less. if the diameter D1 at the end is smaller than 0.4 mm, the waste of the electrode by sparks increases even if a platinum alloy or an iridium alloy is used for the end of the central electrode 2' and it is not practical.

Figure 14:
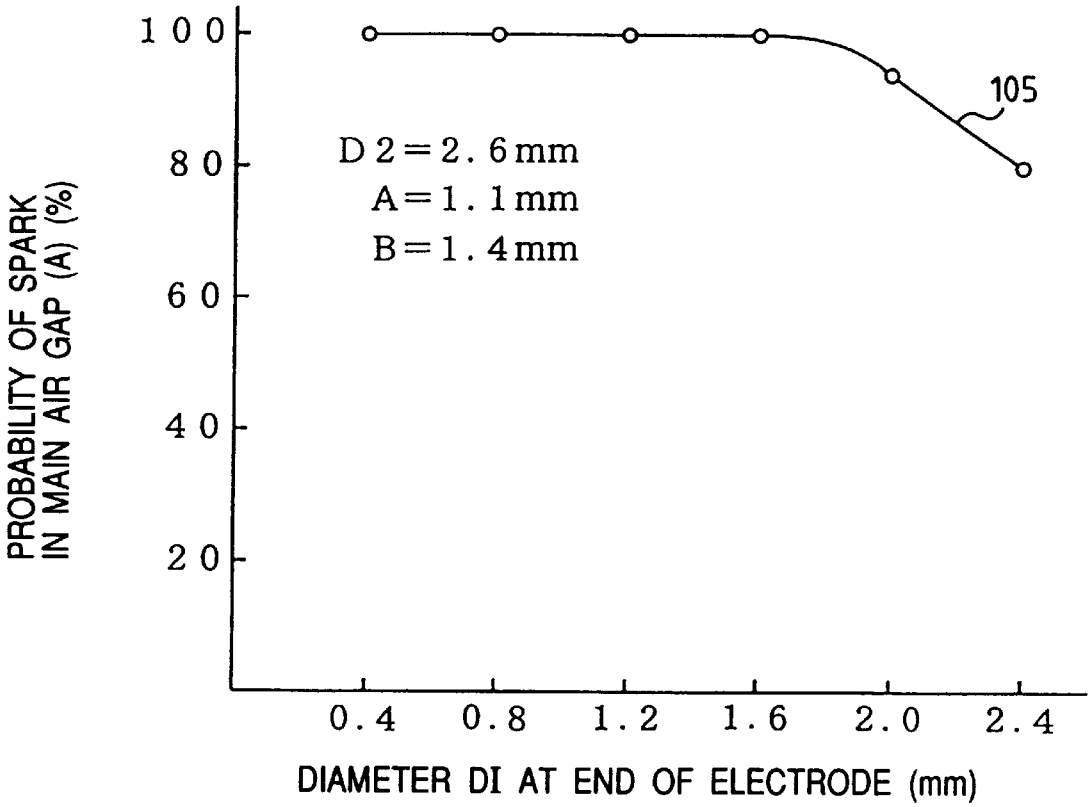
FIG. 14 is a graph showing relationship between the diameter D1 at the end of a central electrode and the probability of a spark in a main air gap (A)

FIG. 14 is a graph showing relationship between the diameter D1 at the end of the central electrode and the probability of a spark in a main air gap (A). A curve 105 shows the probability of a spark in the main air gap (A) at normal time which is not carbon fouling time. A spark plug the diameter D2 at the base of the central electrode of which is 2.6 mm, the distance A of the main air gap (A) of which is 1.1 mm and the distance B of a semi-surface gap (B) of which is 1.4 mm is used. As discharge voltage increases as the diameter of the central electrode 2' is increased, the probability of a spark in the main air gap (A) is reduced from 100% when the diameter D1 at the end of the central electrode exceeds 1.6 mm at normal time and it becomes unstable in which of the main air gap (A) or the semi-surface gap (B) discharge is to be executed.

For the above reasons, it is desirable that the diameter D1 at the end of the central electrode 2' is 0.4 mm or more and 1.6 mm or less (0.4≦D1≦1.6 mm).

(Grounds that (D1+0.3)≦D2 mm)

To fly sparks in the semi-surface gap (B) at carbon fouling time and to stably fly sparks in the main air gap (A) at normal time, it is desirable that the diameter D2 at the base of the central electrode 2' is thicker than the diameter D1 at the end. If the diameter D2 at the base of the central electrode is thick, more heat is reduced from the end of the central electrode and the end of the central electrode is prevented from being overheated. Therefore, it was judged that it was desirable that the diameter D2 at the base of the central electrode was larger than (the diameter D1 at the end of the central electrode +0.3 mm). The upper limit of the diameter D2 at the base of the central electrode is inevitably determined by the thickness of the insulator 1 required for insulation in the vicinity of the lower end of the insulator 1.

(Grounds that 2.0≦D2 mm)

To further effectively prevent the overheat at the end of the central electrode and inhibit the waste of the central electrode in the case of discharge in the semi-surface gap (B), it is desirable that the diameter D2 at the base of the central electrode is thickened. As the concentration of electric fields is softened by thickening the diameter D2 at the base of the central electrode, the rate of the generation of sparks in the semi-surface gap (B) at normal time can be reduced.

To test the above, samples the distance A of the main air gap (A) of which was set to 1.0 mm, the distance B of the semi-surface discharge gap (B) of which was set to 1.5 mm, the distance C of a semi-surface air gap (C) of which was set to 0.5 mm and the diameter D2 at the base of the central electrode of each of which was varied were installed in an engine and were evaluated based upon the maximum value Δd of the wasted quantity of the side of each central electrode after an endurance test at 6000 rpm×WOT (full throttle) is made.

In the above test, a straight 6-cylinder engine provided with the displacement of 2 liter is used and the condition of the test is 400 hours at 6000 rpm×WOT (full throttle). In the test, a general breakerless transistor igniter the spark discharge energy of which is approximately 70 mJ is also used.

As a result, the result of the test shown in the following table was acquired. In the table, ◎ shows the dimension of the diameter D2 when the maximum wasted quantity Δd is smaller than 0.35 mm, ○ shows the dimension of the diameter D2 when the maximum wasted quantity Δd is 0.35 mm or more and 0.5 mm or less and Δ shows the dimension of the diameter D2 when the maximum wasted quantity Δd exceeds 0.5 mm.

TABLE 2

| Dimension of D2 | Maximum wasted quantity Δd |
|---|---|
| 1.5 | Δ |
| 1.75 | ○ |
| 2.0 | ◎ |
| 2.25 | ◎ |
| 2.5 | ◎ |

As clear from the above table 2, it is desirable that the diameter D2 at the base of the central electrode is 2.0 mm or more (2.0≦D2 mm). It is considered that the reason why the maximum value Δd of the wasted quantity of the central electrode decreases when the diameter D2 at the base of the central electrode is thickened is that the volume of the electrode wasted per one spark is approximately fixed and that the rate of the generation of a spark in the semi-surface gap (B) can be reduced because the concentration of electric fields is reduced by thickening the diameter D2 at the base of the central electrode.

Next, referring to the drawings, third and fourth embodiments of the present invention will be described.

As these embodiments are the same as the first and second embodiments except the shape of each semi-surface ground electrode 12, the description is omitted and only different parts will be described below.

Figure 15:
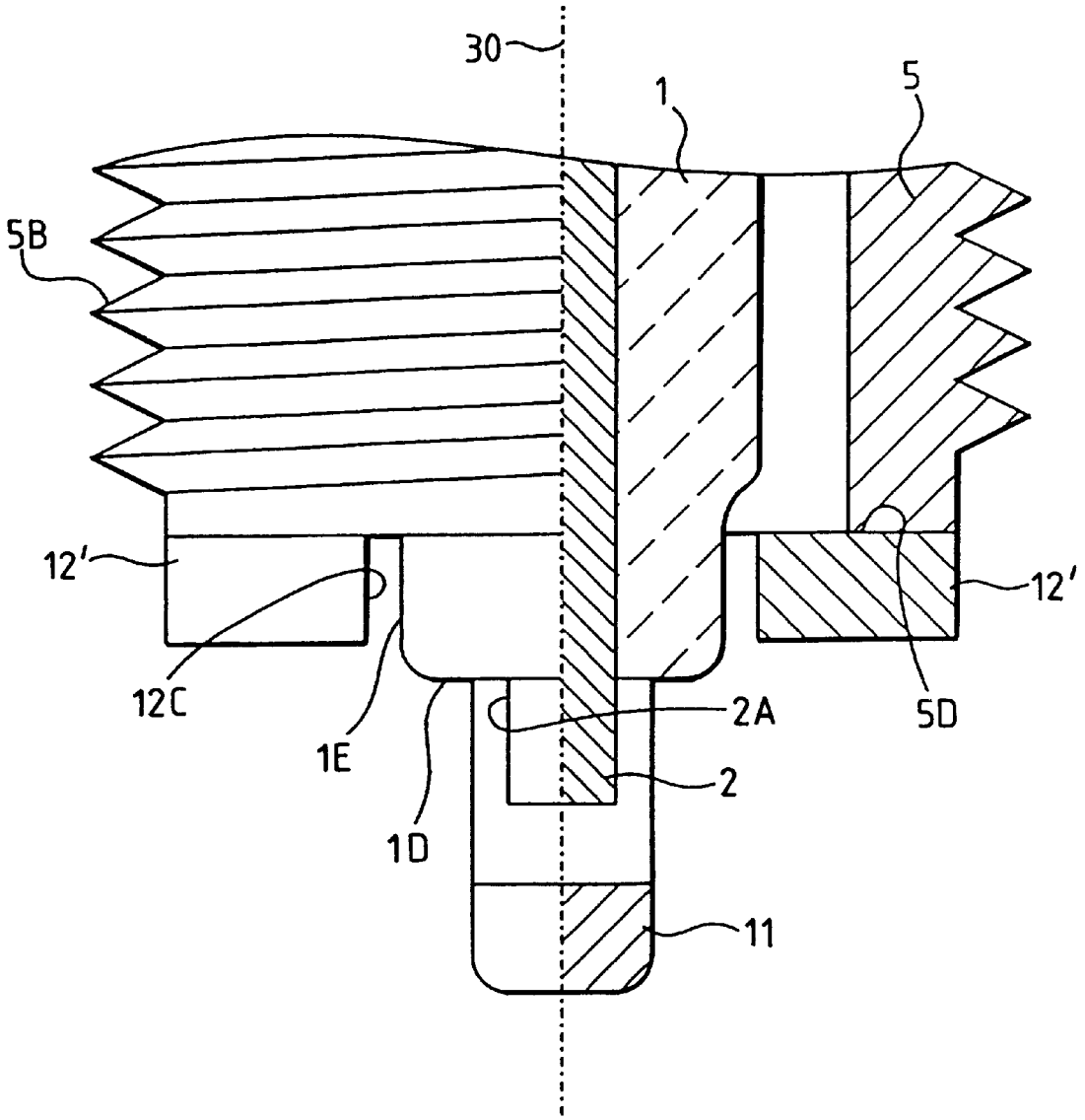
FIG. 15 is a partial sectional view showing the enlarged vicinity of an electrode of a spark plug equivalent to a third embodiment.

FIG. 15 is a partial sectional view showing a third embodiment with a central electrode 2, a parallel ground electrode 11 and a semi-surface ground electrode 12' and the vicinity of the lower end of main metal shell 5 respectively of a spark plug enlarged. The semi-surface ground electrode 12' is formed in the shape of a straight pole and the side is resistance-welded to the lower end face 5D of the main metal shell 5.

Figure 16:
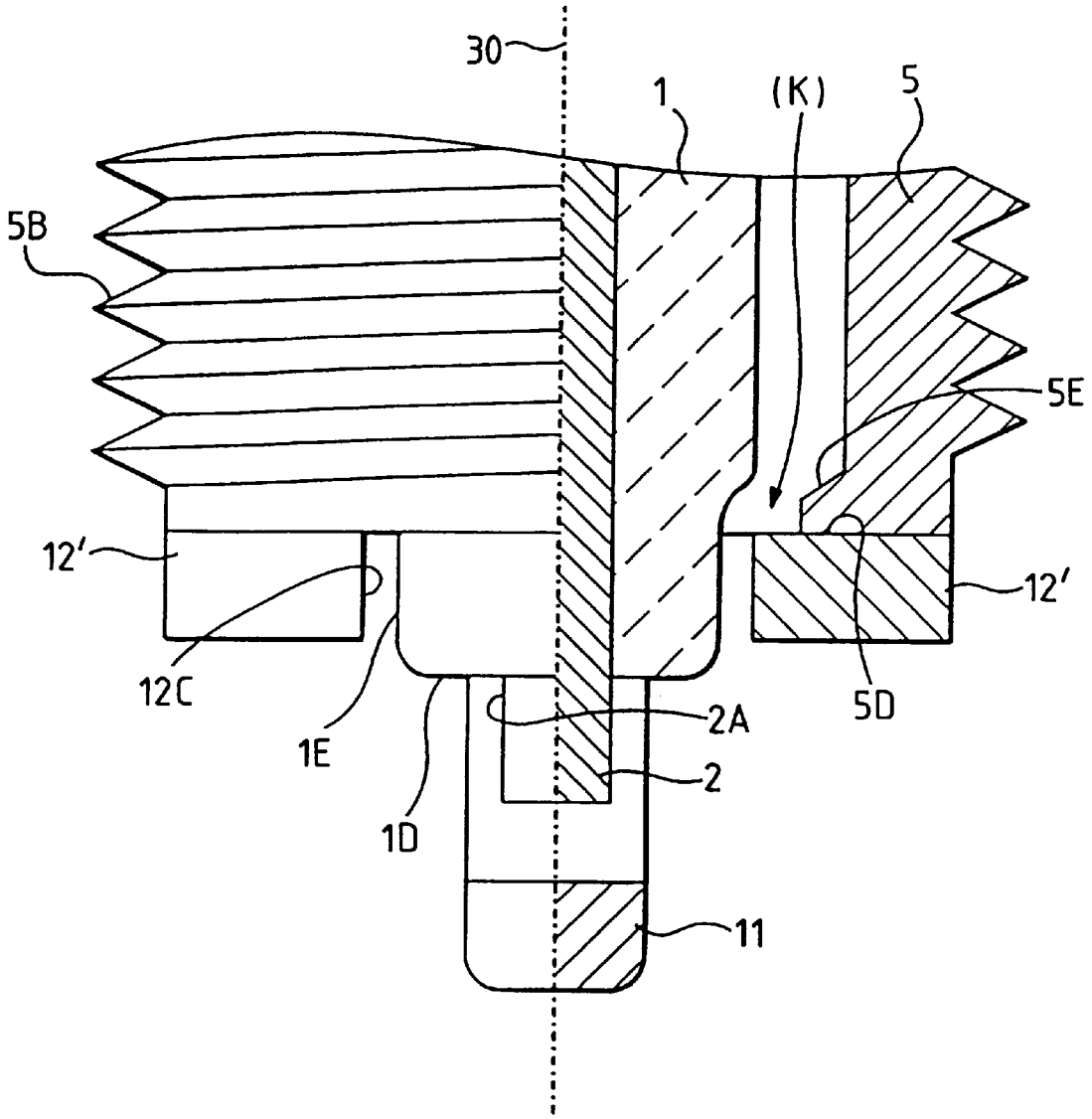
FIG. 16 is a partial sectional view showing the enlarged vicinity of an electrode of a spark plug equivalent to a fourth embodiment.

FIG. 16 is a partial sectional-view showing a fourth embodiment with a central electrode 2, a parallel ground electrode 11, a semi-surface ground electrode 12' and the vicinity of the lower end of main metal shell 5 respectively of a spark plug enlarged. The lower end face 5D is formed so that it is wide by forming a protruded part 5E protruded on the side of the inner diameter at the lower end of the main metal shell 5 and an auxiliary gap (K) is provided between the main metal shell and insulator 1. A semi-surface ground electrode 12' in the shape of a straight pole is resistance-welded to the lower end face 5D formed so that it is wide. As the semi-surface ground electrode 12' is not required to be bent in approximately the shape of a letter L on the side of the central electrode 2 in the vicinity of a bonded part to the end face of the main metal shell by forming as described above, no manufacturing problem such as breakage and a crack is caused.

(Integrated test)

To test the effect of the spark plug according to the present invention, the test of carbon fouling and a channeling test were made using a general spark plug (type PFR6G-11), a semi-surface spark plug (type BKR6EKUC) and the spark plugs equivalent to the first and second embodiments of the present invention.

In the test of carbon fouling, a 4-cycle general purpose engine provided with a single cylinder of 440 cc is used and severe operation of idling operation in a state that a choke is half open was executed. As a result, in the case of the general spark plug, an engine stall was caused due to a carbon fouling after operation for five minutes. Though the semi-surface spark plug bears longer operation than the general spark plug, an engine stall was caused due to a carbon fouling at operation for fifteen minutes. In the meantime, the spark plugs equivalent to the first and second embodiments of the present invention continued to be operated for twenty minutes without a problem. It is considered that the reason why the spark plug according to the present invention is superior to the semi-surface spark plug is that in the case of the spark plug according to the present invention, the state of combustion is good because sparks fly in the main air gap (A) at normal time and that quantity in which incomplete combustion which causes a carbon fouling is caused is small.

In the channeling test, a continuous spark durability test for 100 hours was executed at 100 Hz using a breakerless transistor power source under environment that pressure is 0.8 MPa. As pressure in a normal combustion chamber immediately before ignition is approximately 0.4 Mpa, pressure is applied. As a result, a large trace of channeling is left on the surface of insulator in the semi-surface spark plug and the dept reaches 0.4 mm at the maximum. In the meantime, in the general spark plug and the spark plugs equivalent to the first and second embodiments of the present invention, no trace of channeling could be detected.

(Other Embodiments)

In the above embodiments, two semi-surface ground electrodes 12 are provided, however, a single semi-surface ground electrode may be also provided or multiple semi-surface ground electrodes composed of three or more may be also provided. However, as in the case of a single one, it is difficult to burn off carbon by sparks across the whole end face of insulator and cleanness by sparks is deteriorated, it is considered that it is desirable that two or three semi-surface ground electrodes are provided.

The spark plug in which the diameter of the central electrode is not reduced (not so-called thermostat) inside the end of the insulator is described. However, the diameter of a spark plug may be also reduced at one or more stages.

As described above, as in the present invention, the semi-surface ground electrodes are provided in the vicinity of the lower end face of the insulator in addition to the parallel ground electrode for executing main discharge, the present invention is provided with the self-cleaning action of burning off carbon by semi-surface discharge from the semi-surface ground electrode at carbon fouling time at which the surface of the insulator is fouled by carbon and as the main discharge is executed by the parallel ground electrode, there is excellent effect that the present invention is extremely strong in a carbon fouling, is provided with high ignitability, channeling is hardly caused and a long life is given.

What is claimed is:

1. A spark plug comprising:

an insulator having a central through hole;

a central electrode held in said central through hole and protruded from the lower end face of said insulator downward;

a main metal shell for holding said insulator;

a parallel ground electrode having one end which is bonded to the main metal shell and the other end which is arranged so that the other end is opposite to the end face of said central electrode for holding said insulator and a parallel ground electrode arranged, in which a main air gap is formed by said parallel ground electrode and the end face of said central electrode; and at least one semi-surface ground electrode having one end which is bonded to said main metal shell and the other end which is arranged so that the other end is opposite to the side face of said central electrode or the side face of said insulator, a semi-surface gap being formed between the end face of the other end of said semi-surface ground electrode and the side face of said central electrode opposite to the end face, a gap between a semi-surface and the insulator is formed between the end face of said semi-surface ground electrode and the side face of said insulator opposite to the end face;

wherein difference in a level E between the height of the lower end face of said insulator and the height of the upper edge of the end face of said semi-surface ground electrode is equal to or smaller than +0.7 mm where '+' means a direction in which the upper edge of the end face of the semi-surface ground electrode separates downward from the lower end face of the insulator;

the distance B of said semi-surface gap (B) is longer than the distance A of said main air gap (A); and if a first extended line acquired by extending a line showing said lower end face of said insulator outward, a second extended line acquired by extending a line showing the side face in the vicinity of the semi-surface gap (B) of said insulator in the direction of said lower end face and a third extended line (33) acquired by extending a line showing the end face of said semi-surface ground electrode downward are drawn in case the end face of said semi-surface ground electrode and said insulator are cut along the central axis of said insulator, distance that is a distance C of a semi-surface air gap (C) between the intersection of said first and second extended lines and the intersection (P2) of said first and third extended lines is shorter than the distance A of said main air gap (A).

2. A spark plug according to claim 1, wherein a relationship between the distance A of said main air gap (A), the distance B of said semi-surface gap (B) and the distance C of said semi-surface air gap (C) is $A \leqq (0.8\ (B-C)+C)$(mm).

3. A spark plug according to claim 1, wherein the distance B of said semi-surface gap (B) is equal to or shorter than 2.2 (mm); and the distance C of said semi-surface air gap (C) is in the range of 0.4 to (A−0.1) (mm), where A indicates the distance of the main air gap (A).

4. A spark plug according to claim 3, wherein difference in a level E between the height of the lower end face of said insulator and the height of the upper edge of the end face of said semi-surface ground electrode is equal to or smaller than +0.5 (mm), where '+' means a direction in which the upper edge of the end face of said semi-surface ground electrode separates downward from the lower end face of said insulator.

5. A spark plug according to claim 4, wherein said difference in a level E is equal to or smaller than −0.7 (mm).

6. A spark plug according to claim 1, wherein quantity H in which said central electrode is protruded from the lower end face of said insulator is in the range of 1.0 to 4.0 (mm).

7. A spark plug according to claim 1, wherein the diameter at the end of said central electrode is reduced, compared with the diameter of the base protruded from the lower end face of said insulator;

the diameter D1 at the end of the central electrode is in the range of 0.4 to 1.6 (mm); and the diameter D2 at the base of the central electrode on the lower end face of the insulator is equal to or longer than (D1+0.3) (mm).

8. A spark plug according to claim 7, wherein the diameter D2 at the base of said central electrode is equal to or longer than 2.0 (mm).

9. A spark plug according to claim 1, wherein the end of said central electrode is comprised of noble metal having the melting point of 1600° C. or more.

10. A spark plug according to claim 1, wherein said semi-surface ground electrode is a straight pole; and the side of this semi-surface ground electrode is bonded to the lower end face of said main metal shell.

11. A spark plug according to claim 9, wherein said noble metal is one of a platinum alloy and an iridium alloy.

12. A spark plug according to claim 4, wherein the cross section of the semi-surface ground electrode is 3 $mm^2$ or smaller.

13. A spark plug according to claim 8, wherein said central electrode contains 85% or more of nickel.

14. A spark plug according to claim 8, wherein the diameter D2 at the base of the central electrode is set to approximately the double of the distance A of the main air gap (A) or longer.

* * * * *

UNITED STATES PATENT AND TRADEMARK OFFICE

CERTIFICATE OF CORRECTION

PATENT NO. : 6,229,253 B1
APPLICATION NO. : 09/329311
DATED : May 8, 2001
INVENTOR(S) : Kazuya Iwata et al.

It is certified that error appears in the above-identified patent and that said Letters Patent is hereby corrected as shown below:

IN THE CLAIMS

In Col. 17, claim 1, line 36, delete "for holding said insulator"

In Col. 17, claim 1, line 37, delete "and a parallel ground electrode arranged"

Signed and Sealed this
Fifth Day of April, 2011

David J. Kappos

David J. Kappos
*Director of the United States Patent and Trademark Office*